US006923581B2

(12) United States Patent
Ueda et al.

(10) Patent No.: US 6,923,581 B2
(45) Date of Patent: Aug. 2, 2005

(54) PRINTER USING INK RIBBON

(75) Inventors: Masahiko Ueda, Musashino (JP); Tetsuya Yamamoto, Kodaira (JP)

(73) Assignee: Citizen Watch Co., Ltd., Tokyo (JP)

( * ) Notice: Subject to any disclaimer, the term of this patent is extended or adjusted under 35 U.S.C. 154(b) by 238 days.

(21) Appl. No.: 10/287,812

(22) Filed: Nov. 5, 2002

(65) Prior Publication Data

US 2003/0094109 A1 May 22, 2003

(30) Foreign Application Priority Data

Nov. 5, 2001 (JP) ..... 2001-339676

(51) Int. Cl.[7] ..... B41J 11/44
(52) U.S. Cl. ..... 400/61; 400/70; 400/76
(58) Field of Search ..... 400/61, 70, 76, 400/223, 225, 232, 234; 156/387

(56) References Cited

U.S. PATENT DOCUMENTS 4,623,902 A * 11/1986 Yamanishi ..... 347/217
5,490,638 A * 2/1996 Driftmyer et al. ..... 242/421
5,529,410 A * 6/1996 Hunter et al. ..... 400/234
5,788,384 A * 8/1998 Goodwin et al. ..... 400/208
5,820,277 A * 10/1998 Schulte ..... 400/223
6,082,914 A * 7/2000 Barrus et al. ..... 400/234
6,164,203 A * 12/2000 Keller ..... 101/407.1
6,527,026 B1 * 3/2003 Huggins ..... 156/387

FOREIGN PATENT DOCUMENTS

JP 7-89172 4/1995
JP 07323651 A * 12/1995 ..... B41J/35/36

* cited by examiner

*Primary Examiner*—Charles H. Nolan, Jr.
(74) *Attorney, Agent, or Firm*—Armstrong, Kratz, Quintos Hanson & Brooks, LLP.

(57) ABSTRACT

A plurality of current patterns with regard to driving current which flows in a driving motor for a ribbon winding shaft are set in advance. The driving motor is driven based on the current pattern selected from a plurality of current patterns on an operation panel. The plurality of current patterns are set in advance so that the tension applied to the ink ribbon, which is between a printing head and a ribbon winding shaft, is an approximate predetermined value from the start to the end of ribbon winding according to the kind of the ink ribbon installed on a ribbon supply shaft.

12 Claims, 22 Drawing Sheets

PRINTER USING INK RIBBON

BACKGROUND OF THE INVENTION

1. Field of the Invention

The present invention relates to a printer in which an ink ribbon and paper on the ink ribbon are carried between a print head and a platen, in a state such that they are pressed against each other, for printing on the paper.

2. Description of the Related Art

Hitherto, the above kind of a printer has been provided with a ribbon installing unit. The ribbon installing unit has a configuration in which the unit is provided with a ribbon supply shaft and a ribbon winding shaft, and the ink ribbon installed on the ribbon supply shaft is wound onto the ribbon winding shaft after passing between a printing head and a platen.

It is preferable that predetermined winding tension is applied to the ink ribbon which is wound onto the ribbon winding shaft, and, when there are variations in the above winding tension, there is a possibility that wrinkles are generated on the ink ribbon during printing to cause printing problems.

A conventional printer in which the torque of the ribbon winding shaft is adjusted in order to apply predetermined tension to the ink ribbon from the start to the end of ink ribbon winding has been known.

Though there have been conventional printers in which a plurality of kinds of ink ribbons, which are different in the size from each other, can be installed, there have been no printers in which the torque of the ribbon winding shaft may be adjusted to the best one according to various kinds of ink ribbons which are different in the size from each other. For example, even when there are different kinds of ink ribbons, for example, ink ribbons with a narrow width and those with a broad width, the torque of the winding shaft has been adjusted to the same values for the above different ink ribbons. Accordingly, when the axial torque is set to a suitable value, for example, for a ink ribbon with a broad width, excessive tension is applied to a ink ribbon with a narrow width. That is, there has been a possibility that wrinkles are generated on the ink ribbon and printing problems are generated.

SUMMARY OF THE INVENTION

Accordingly, the present invention has been made considering the above circumstances, and it is an object of the invention to give suitable winding tension to a ink ribbon according to the size of the ink ribbon. That is, a printer according to a first aspect of the invention has a configuration in which an ink ribbon and paper on the ink ribbon are carried between a print head and a platen, in a state such that the ink ribbon is pressed against the paper, for printing on the paper, and comprises:

a ribbon supply shaft which supports the ink ribbon supplied between the printing head and the platen;

a ribbon winding shaft which winds the ink ribbon sent from the ribbon supply shaft;

a driving motor which drives and rotates the ribbon winding shaft;

a storage unit which stores a plurality of current patterns for the driving current of the driving motor, the patterns having been set in advance;

a selection unit which selects any one of the plurality of current patterns; and a control unit which drives the driving motor based on the current pattern selected with the selection unit.

DESCRIPTION OF THE PREFERRED EMBODIMENTS

Hereinafter, a line thermal printer according to preferred embodiments of the present invention will be explained, referring to drawings.

Figure 1:
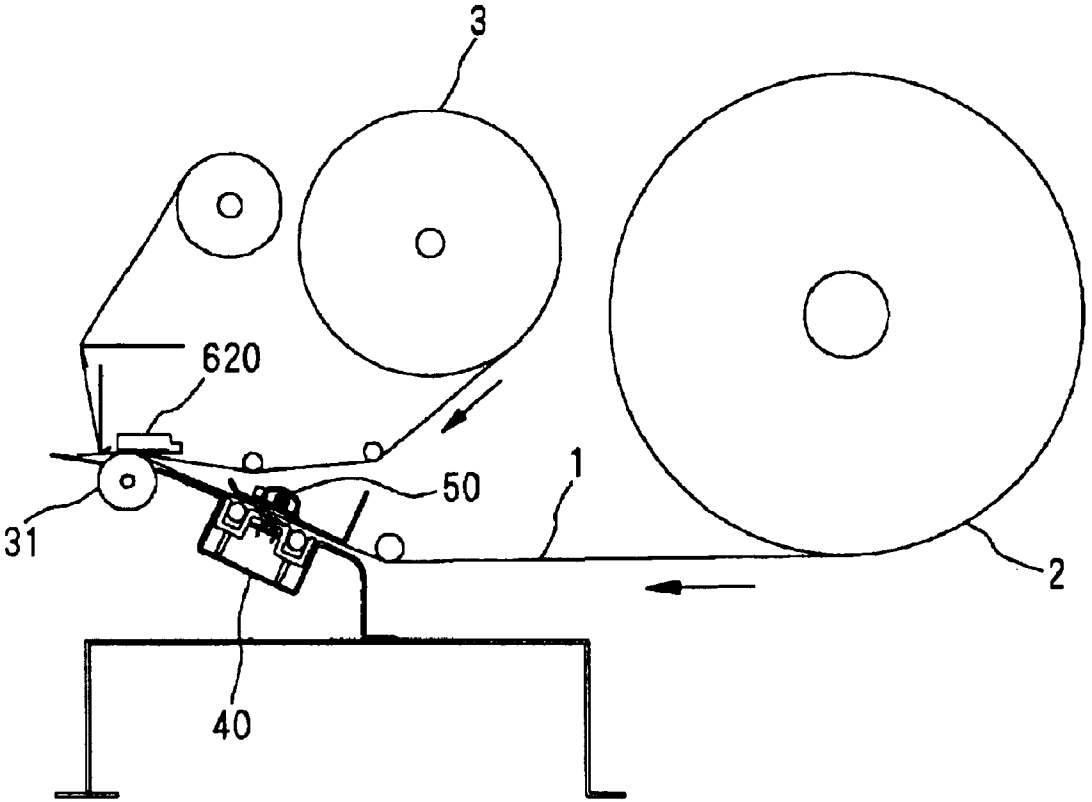
FIG. 1 is an exemplary schematic view showing a line thermal printer according to one embodiment of the present invention.

As shown in FIG. 1, the line thermal printer has a configuration in which roll paper 2 which has been drawn out along a paper carrying path 1 is inserted between a platen 31 and a thermal head 620, and an ink ribbon 3 is supplied to therebetween. Ink applied to the ink ribbon 3 is melted by the thermal head 620 and transferred onto the surface of the roll paper 2. Thereby, printing on the roll paper 2 is realized.

Label paper in which a label is pasted on a mount and tag paper in which a tag is pasted on a mount may be listed as the roll paper 2. Thereupon, a lower sensor unit 40 and a upper sensor unit 50 are disposed along the paper carrying path 1, and the position of a label or a tag which is pasted on a mount of the label paper or the tag paper is configured to be detected by the above sensor units 40 and 50.

Figure 2:
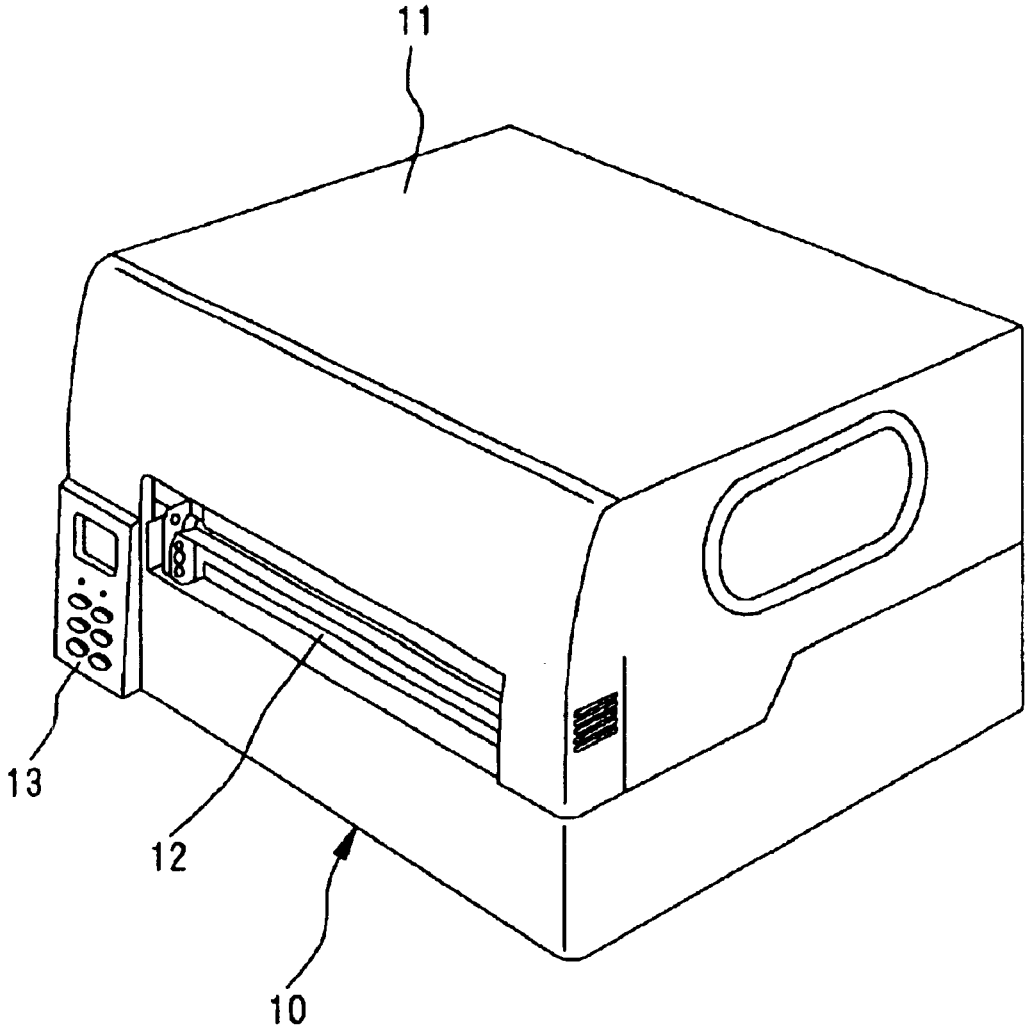
FIG. 2 is a perspective view showing an appearance of the line thermal printer according to the embodiment of the present invention.

As shown in FIG. 2, the upper part of the case of the main body 10 in the line thermal printer is covered by an opening/closing top cover 11. A paper delivery slit 12 which delivers paper after printing and an operation panel 13 for various kinds of setting are provided at the front of the line thermal printer.

Figure 3:
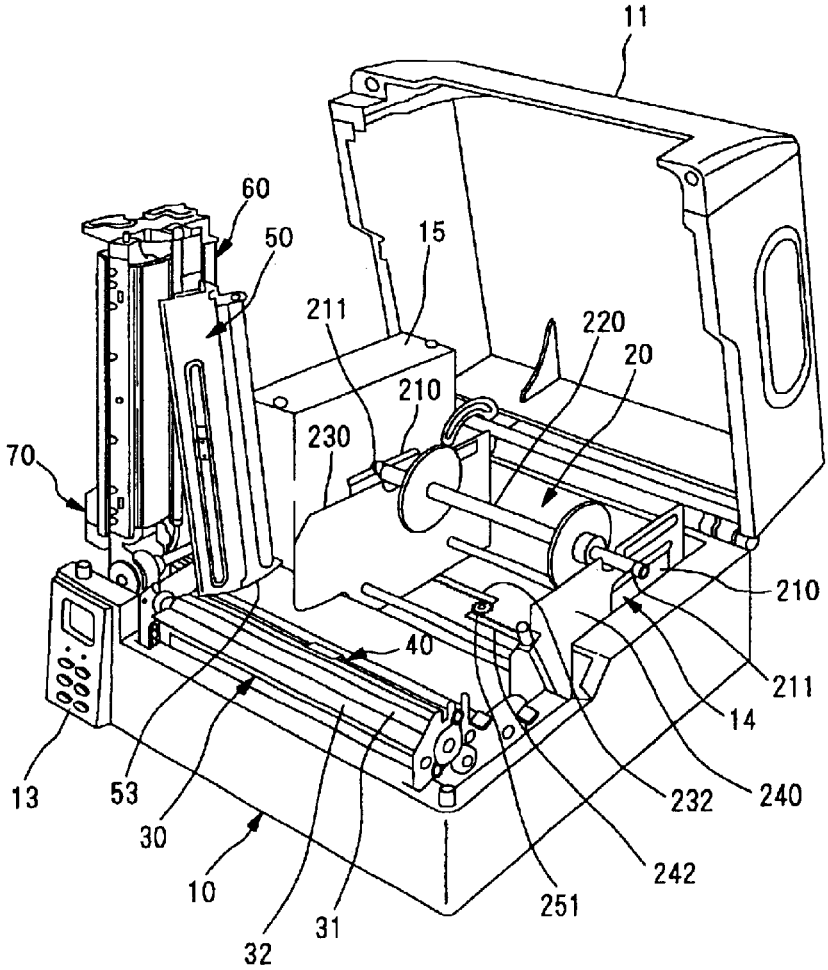
FIG. 3 is a perspective view showing an internal structure of the line thermal printer according to the embodiment of the present invention.

As shown in FIG. 3, a main-body frame 14 which supports each components is provided in the case of the main body of the printer. Components such as a control box 15, a roll paper supply unit 20, a front unit 30 which comprises the platen 31, the lower sensor unit 40, the upper sensor unit 50, a head unit 60 and a ribbon installing unit 70 are built into the main-body frame 14.

Here, in order to understand the whole structure of the line thermal printer, setting procedures for the roll paper 2 and the ribbon 3 will be explained, referring to FIGS. 4 to 7.

Figure 4:
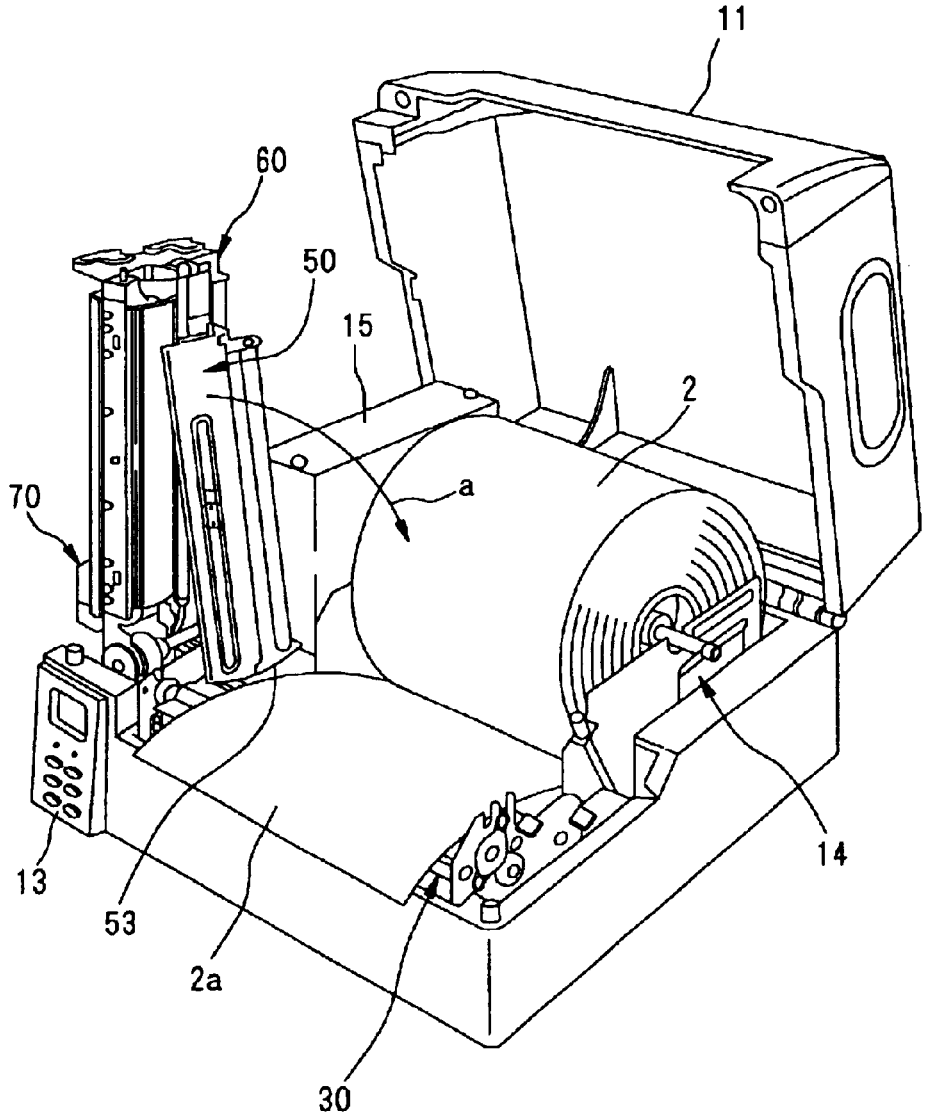
FIG. 4 is a perspective view for explanation of a setting procedure for the line thermal printer according to the embodiment of the present invention.

In the first place, the roll paper 2 is installed into the roll paper supply unit 20, and paper 2*a* which has been drawn out from the roll paper 2 is arranged on the front unit 30 which comprises the lower sensor unit 40 and the platen 31, as shown in FIG. 4.

Figure 5:
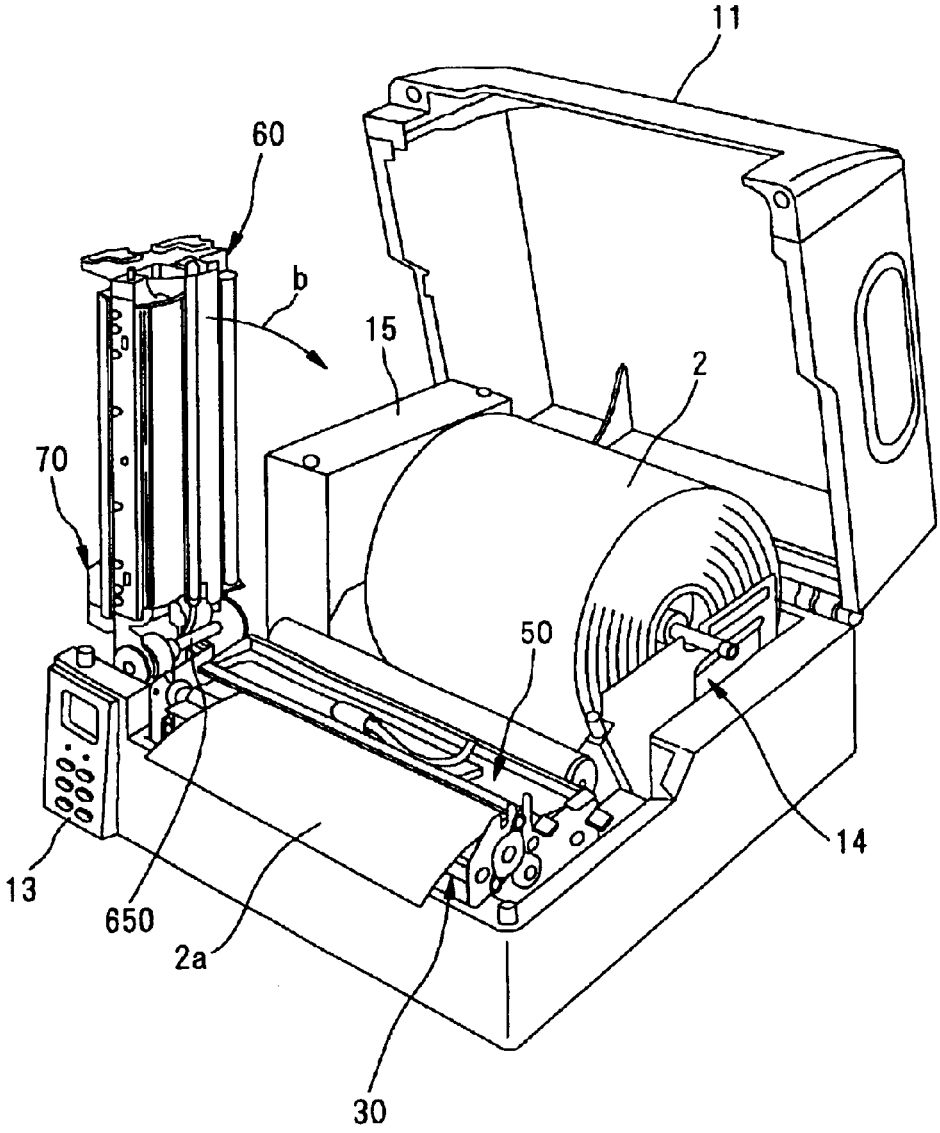
FIG. 5 is a perspective view, continued from FIG. 4, for explanation of the setting procedure for the line thermal printer.

In the second place, the upper sensor unit 50 is put down in the direction of an arrow shown in FIG. 4 to arrange the upper sensor unit 50 on the paper 2*a* as shown in FIG. 5. By the above operation, the upper sensor unit 50 is arranged at a position facing the lower sensor unit 40 through the paper 2*a*.

Figure 6:
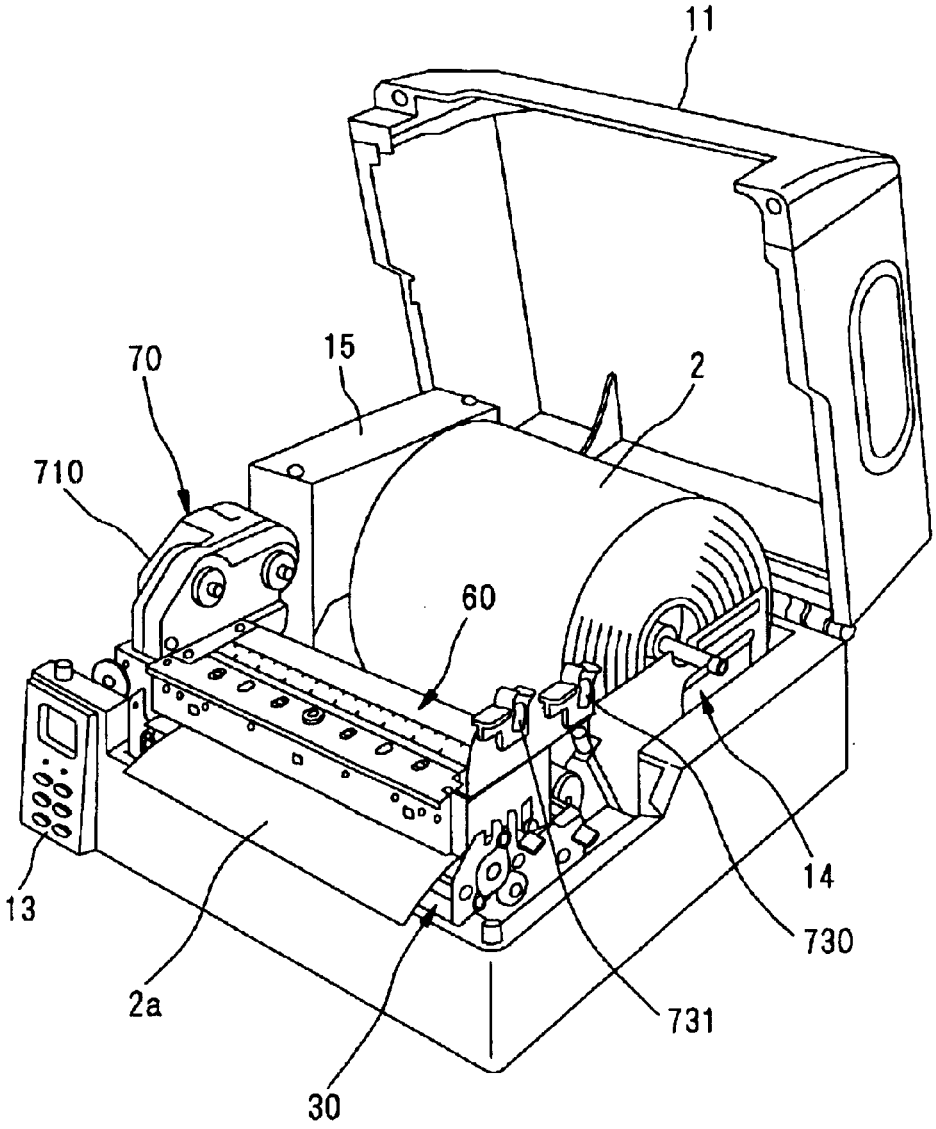
FIG. 6 is a perspective view, continued from FIG. 5, for explanation of the setting procedure for the line thermal printer.

Subsequently, the head unit 60 is put down in the direction of an arrow shown in FIG. 5 to arrange the head unit 60 on the paper 2*a* as shown in FIG. 6. By the above operation, the head unit 60 is arranged at a position facing the platen 31 (Refer to FIG. 3) through the paper 2*a*.

Figure 7:
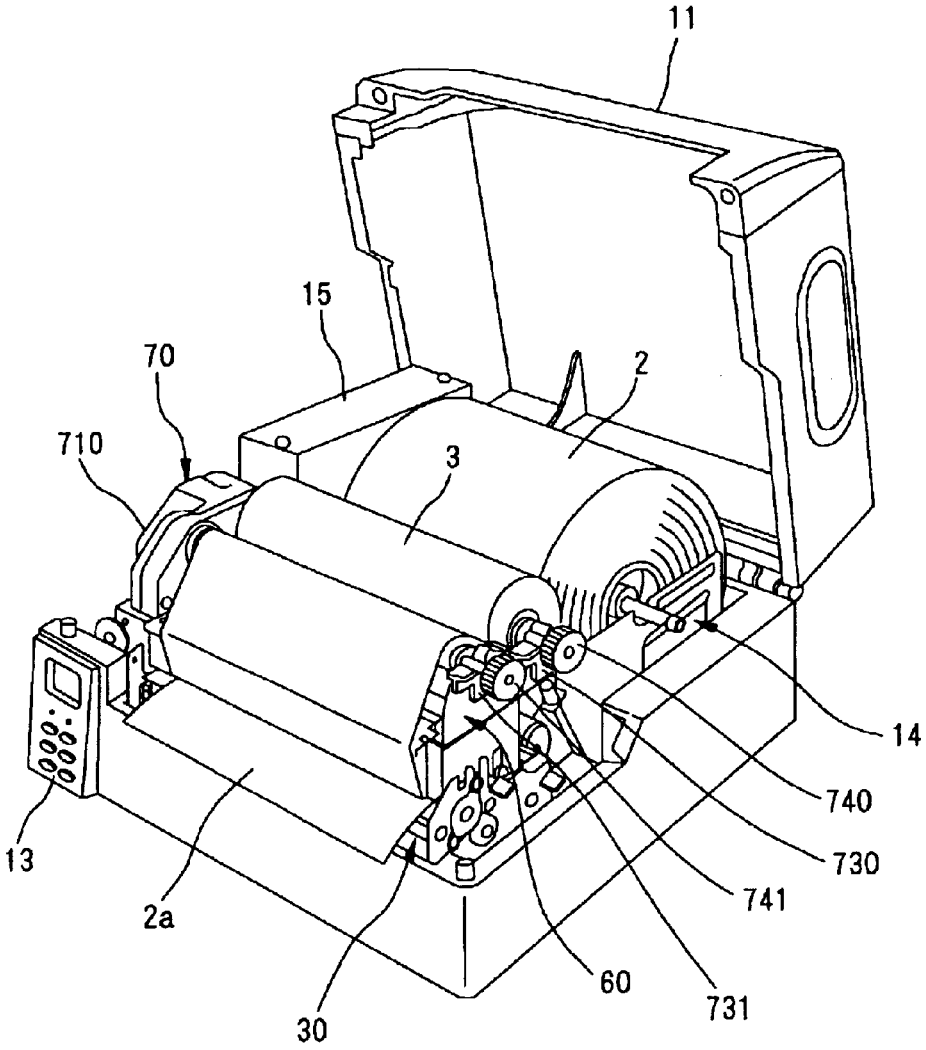
FIG. 7 is a perspective view, continued from FIG. 6, for explanation of the setting procedure for the line thermal printer.

The roll ribbon 3 in a roll state is installed into the ribbon installing unit 70 under a state in which the head unit 60 is standing as shown in FIG. 5. By the above operations, setting of the roll paper 2 and the ribbon 3 is performed as shown in FIG. 7. Thereafter, the top cover 11 is closed to generate an external appearance, which is shown in FIG. 2*a*, of the line thermal printer which is actually being used.

Then, each component will be further explained in detail.

In the control box 15 which is shown in FIG. 3, a control circuit which executes operation control of the line thermal printer, an interface circuit which processes data signals which are sent from a connecting device such as a computer, memories which store set information input from the operation panel 13 and the like are self-contained.

The roll paper supply unit 20 is built in the after part inside the case 10 of the main body of the printer as shown in FIG. 3 and comprises a support plate 210, a roll shaft 220, a left roll guide 230 and a right roll guide 240.

The support plates 210 form a part of the main-body frame 14 and have roll supporting sections 211 which comprise concave parts with a semicircular shape at the top and center part.

Figure 8:
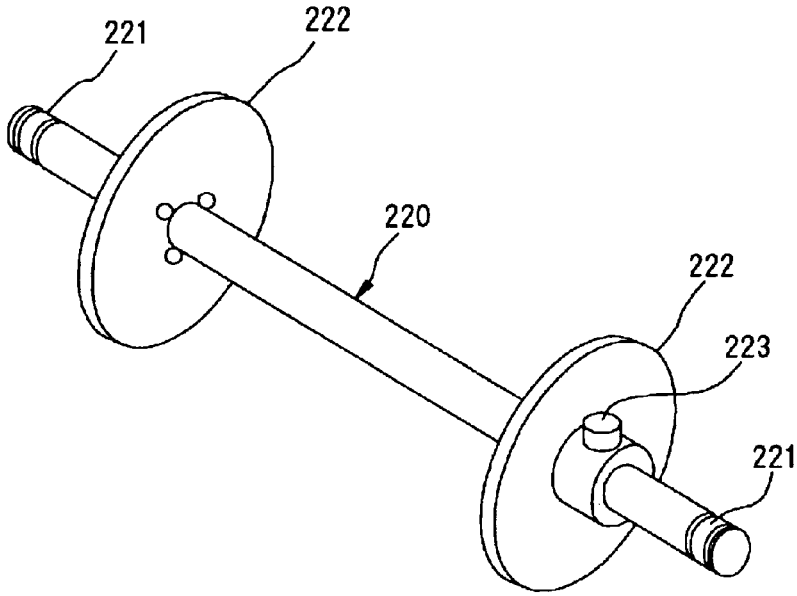
FIG. 8 is a perspective view showing a roll shaft.

As shown in FIG. 8, the roll shaft 220 is of a metal rod and is inserted through a central hole of the roll paper 2. The roll paper 2 is rotatably supported by mounting the both end parts of the roll shaft 220 on the roll supporting section 211.

Bearings 221 (sliding bearings) are provided in parts at which the both ends of the roll shaft 220 are resting on the roll supporting sections 211, respectively, and relative rotation of the above bearings 221 reduce rotating resistances at delivering the roll paper 2 to enable smooth delivery of the roll paper 2.

Moreover, a pair of holder disks 222 with a disk shape are removably installed in the middle part of the roll shaft 220. A suitable outer diameter of the holder disks 222 may be selected according to the inner diameter of the center hole of the roll paper 2. The holder disks 222 are installed on the roll shaft 220 to allow positioning of the roll shaft 220 at the center axis of the roll paper 2 and to realize the delivery of the roll paper 2 with no eccentricity. Moreover, even in various kinds of roll papers 2 which have different widths, respectively, the holder disks 222 are inserted by adjusting positions at which the holder disks 222 are fixed into a center hole of the roll paper 2 to support the inside surface of the center hole. The holder disks 222 are fixed onto the roll shaft 220 with fasteners 223 such as screws.

Figure 9:
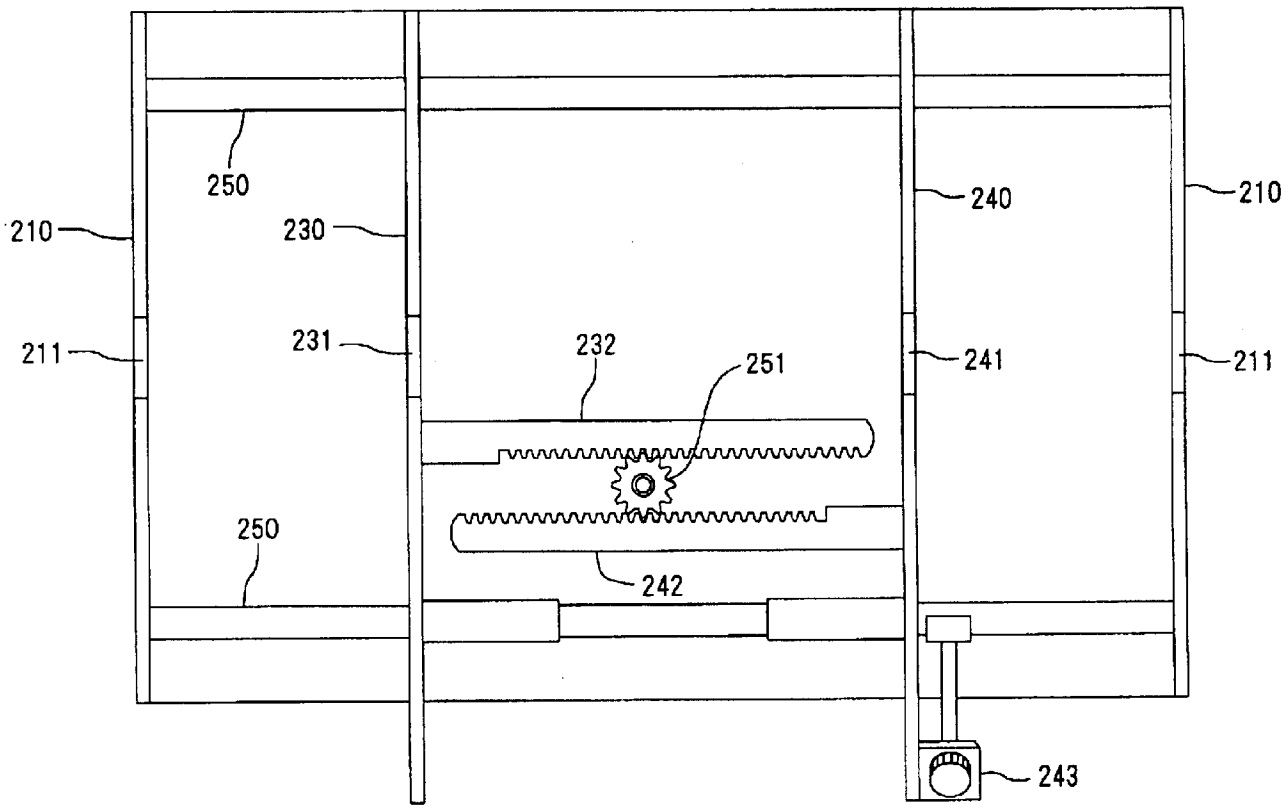
FIG. 9 is a plan view showing a roll-paper supplying unit.

The left roll guide 230 and the right roll guide 240, which are shown in FIG. 3 and are of a metal plate, are disposed inside of the support plates 210 as shown in FIG. 9. Each of the roll guides 230 and 240 is movable along rod-like guide rails 250, which are fixed between the right and left support plates 210, in the axial direction of the roll shaft 220, that is, in the width direction of the supported roll paper 2. The above roll guides 230 and 240 are components for guiding the both end surfaces of the roll paper 2 which is supported by the roll shaft 220. Here, concave sections 231 and 241 are formed at the top and center part of each of the roll guides 230 and 240 to prevent interference with the roll shaft 220.

At the lower end of the left roll guide 230, a left guide rack 232 which is extending inward in the width direction of the supported roll paper 2 is installed, and, on the other hand, at the lower end of the right roll guide 240, a right guide rack 242 which is extending inward in the width direction of the supported roll paper 2 is also installed. In the bottom of the main-body frame 14, a pinion gear 251 is disposed, and the guide racks 232 and 242 engage with the above pinion gear 251 which is inserted between the above racks 232 and 242. When one of the roll guide 230 or 240 is moved in the width direction, the linked movement of the other roll guide 240 or 230 to the above movement is executed by the above mechanism in the opposite direction by the same amount to that of the above movement. Here, the position of each of the roll guides 230 and 240 is adjusted with a center approximately at the center position between the right and left support plates 210 so that the above roll guides 230 and 240 approach or separate each other.

As the distance between the roll guides 230 and 240 is accurately and easily adjusted with a center approximately at the center position between the right and left support plates 210 by the above configuration, even when various kinds of roll papers 2 which have different widths, respectively, are installed, the center position of the roll paper 2 may be kept at that of the support plates 210 at any time by guiding the both end surfaces of the roll paper 2.

Figure 10:
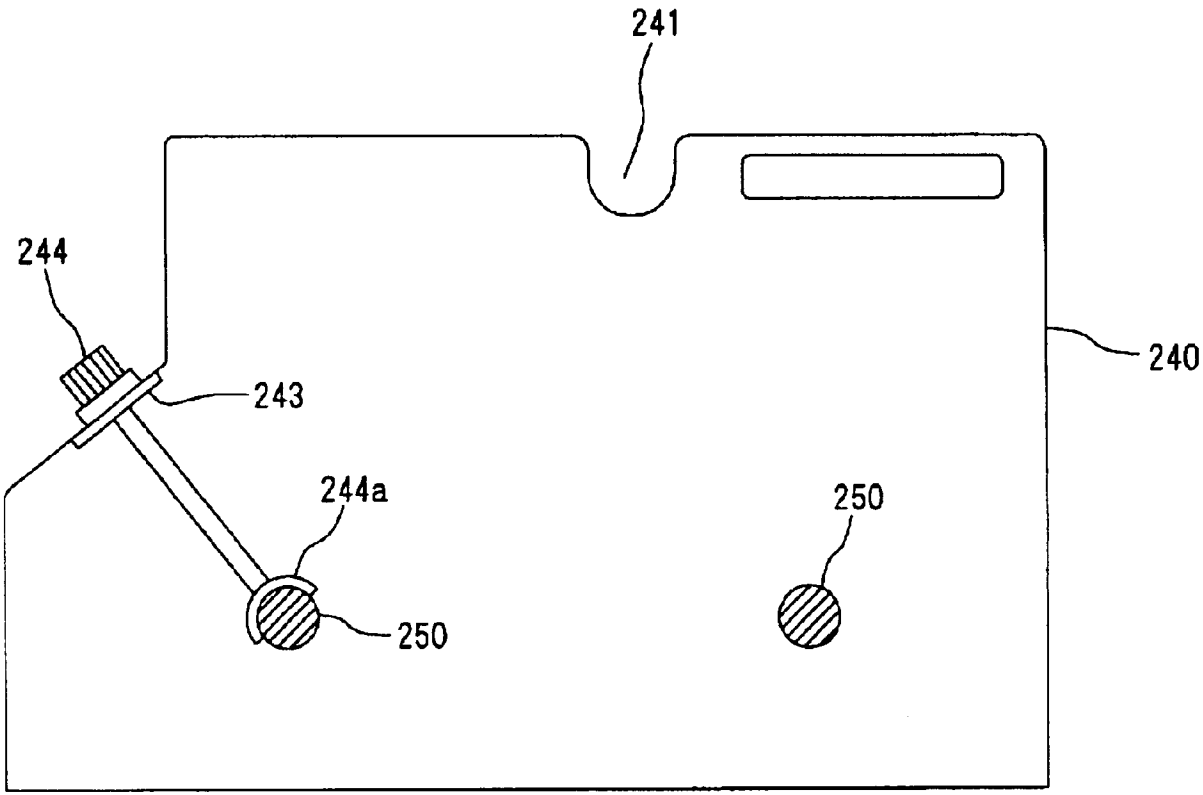
FIG. 10 is a side view of a right roll guide.

Moreover, a fixing operation section 243 is formed at a top corner part of one of the roll guides (for example, the right roll guide 240 in FIG. 9). A screw hole is formed in the fixing operation section 243, and a fixing member 244 which comprises a long screw is screwed through the screw hole as shown in the side view of the roll guide 240 in FIG. 10. The tip of the fixing member 244 is provided with a resting-on section 244*a* which touches or separates from the outer surface of one of the guide rails 250, and free movement of the right roll guide 240 is restricted when the resting-on section 244*a* is pressed into contact with the outer surface of the guide rail 250 by rotation operation of the fixing member 244. As the movement of the right roll guide 240 and that of the left roll guide 230 are linked to each other through the guide racks 232 and 242 and the pinion gear 251 as described above, the movement of the roll guide 230 which is one of the roll guides 230 and 240 is simultaneously restricted when that of the other roll guide 240 is restricted. Thereby, the both roll guides 230 and 240 may be fixed.

Returning to FIG. 3, the front unit 30 is provided inside of the front of the case 10 of the main body of the printer, that is, at the back of the paper delivery slit 12. The platen 31 is rotatably built in the front unit 30. The platen 31 is a member in which an elastic material such as synthetic rubber is provided around a rotation shaft and has functions to support the rear face of the paper at printing and to carry the paper along with the rotation. And, a paper cutting plate 32 with a sharp tip which is called as a tear bar is installed in the front unit 30, and the printed paper 2*a* is cut in cooperation of a not-shown cutter which is installed in the head unit 60.

Figure 11:
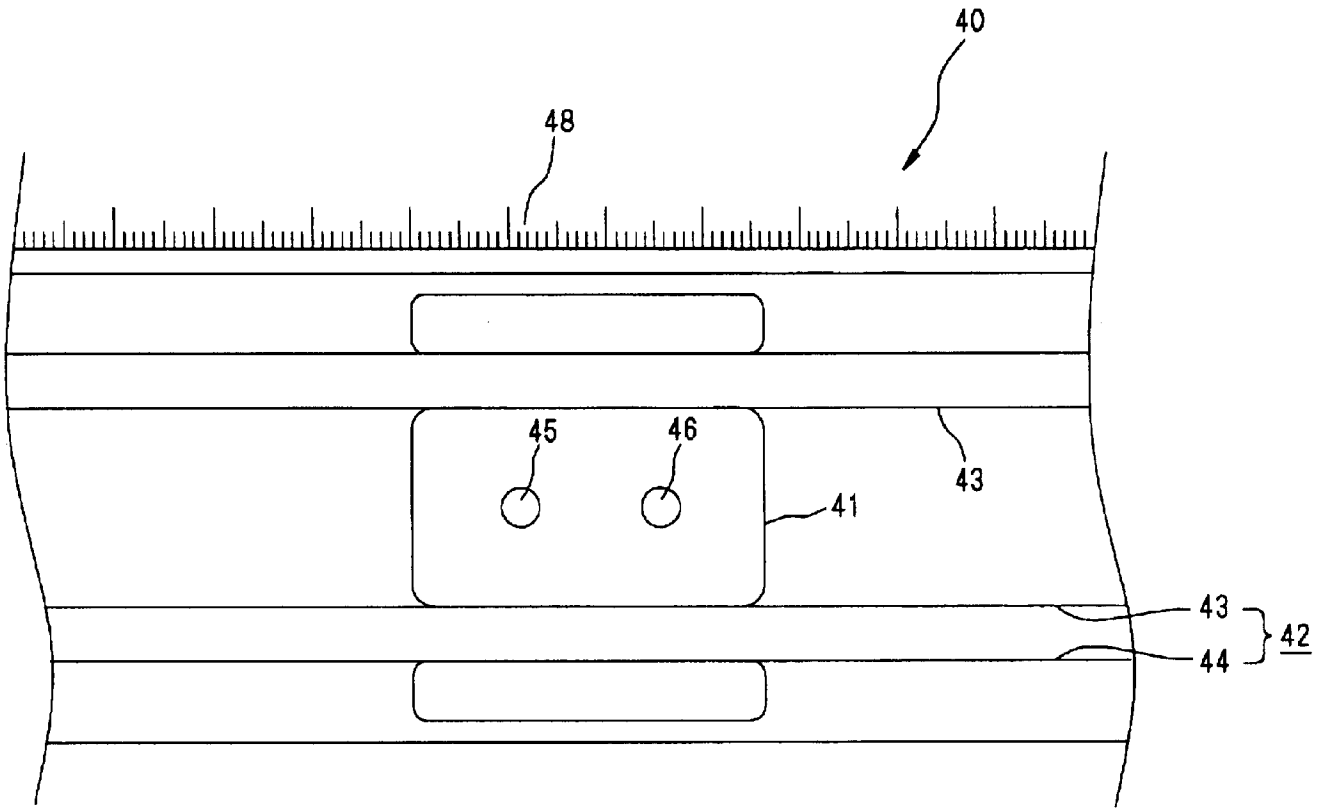
FIG. 11 is a plan view showing a lower sensor unit.
Figure 12:
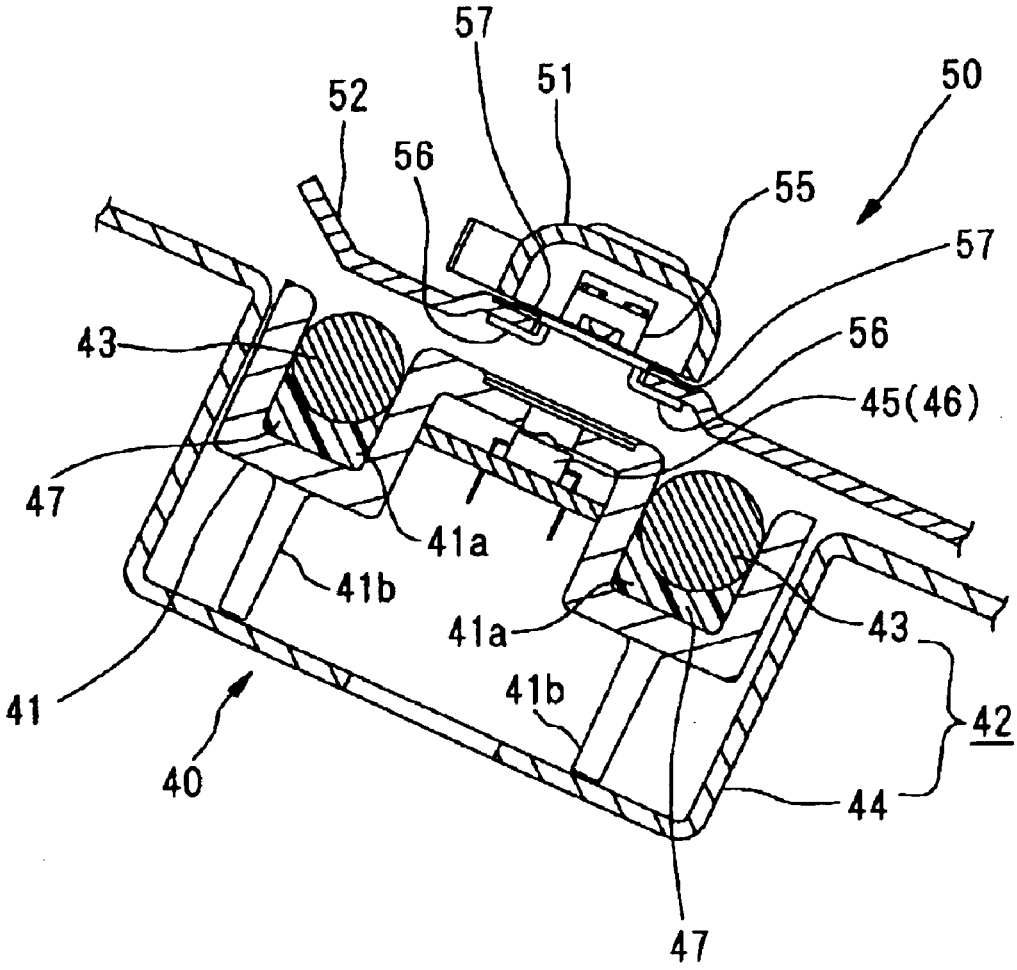
FIG. 12 is a sectional side view showing an upper sensor unit and the lower one.

The lower sensor unit 40 comprises a lower case 41 and a lower guide 42 as shown in FIGS. 11 and 12. The lower guide 42 is disposed at the back of the front unit 30 and comprises two rod-like lower guide shafts 43 and a lower guide plate 44. Among the above, the lower guide plate 44 is a part of the main-body frame 14. The lower guide plate 44 has a concave shape which is shown in FIG. 12, and the lower guide shaft 43 is provided along the opening. The above lower guide plate 44 and lower guide shafts 43 are extending in the width direction of the case 10 of the main body of the printer.

A light emitting element 45 and a first light receiving element 46 are built in side by side in the center part of the lower case 41. Moreover, concave sections 41*a* which engage with the lower guide shafts 43, respectively, are formed at the both end parts of the lower case 41 as shown in FIG. 12. Furthermore, leg sections 41*b* which rest on the bottom surface of the lower guide plate 44 are extending out from the lower surfaces of the concave sections 41*a*, respectively.

In addition, elastic materials 47 which comprise, for example, urethane resin are filled between the concave sections 41*a* of the lower case 41 and the lower guide shaft 43. The lengths of the legs 41*b* are adjusted so that a state in which the elastic materials 47 are suitably compressed is maintained. By the above configuration, the position of the lower case 41 along the lower guide shafts 43 can be easily moved and adjusted, and the position after the above adjusting may be kept by the individual friction force between the suitably compressed elastic materials and the lower guide shafts 43. Here, a graduation 48 is made on the lower guide plate 44 in the width direction as shown in FIG. 11, and positioning of the lower case 41 may be more easily performed by using the graduation 48 as a standard.

Figure 13:
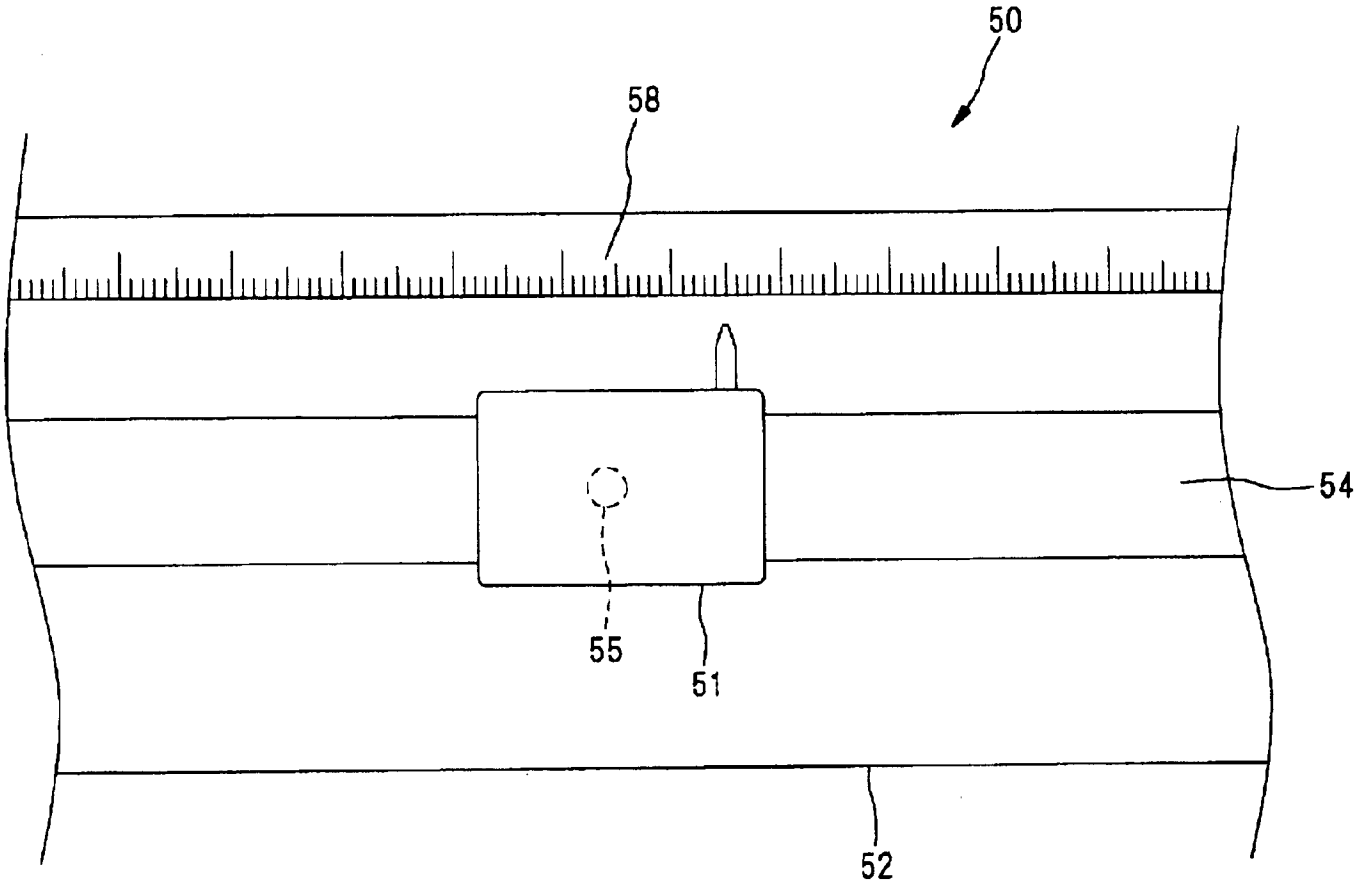
FIG. 13 is a plan view showing the upper sensor unit.

The upper sensor unit 50 comprises an upper case 51 and an upper guide plate 52 as shown in FIG. 13. The upper guide plate 52 is installed on one side of the main-body frame 14 at one end through a hinge section 53 as shown in FIG. 3 and FIG. 4 and is rotatable around the hinge section 53. The other end forms a locking section (not shown), and the locking section engages with a lock lever (not shown) which is provided on the other side of the main-body frame 14 to keep a setting state shown in FIG. 5. In this setting state, the upper guide plate 52 and the lower guide 42 are arranged, facing each other through the paper 2*a*. A guide hole 54 extending in the width direction is formed in the center part of the upper guide plate 52 as shown in FIG. 13.

In the upper case 51, a second light receiving element 55 is built in the center part as shown in FIG. 12. Moreover, support pieces 56 are formed with a predetermined space on the lower surface of the upper case 51 so that the pieces 56 are extending to the both sides. The above support pieces 56 are arranged on the lower surface of the above plate 52 through the guide hole 54 which is formed on the upper guide plate 52 which is inserted between the support pieces 56 and the upper case 51. In addition, an elastic material which comprises a flat spring 57 is installed on the lower surface of the upper case 51, facing the support pieces 56, and spring force caused by the flat spring 57 supports the upper guide plate 52 in cooperation with the support pieces 56.

By the above configuration, the position of the upper case 51 can be easily moved and adjusted along the guide hole 54 of the upper guide plate 52, and the position after the above adjusting may be kept by the individual supporting force between the flat spring 57 and the supporting pieces 56. And, a graduation 58 is made even on the upper guide plate 52 in a similar manner to that of the lower guide plate 44, and positioning of the upper case 51 may be more easily performed by using the graduation 58 as a standard.

The above-described sensor units 40 and 50 are separately used, for example, in the following way, according to what type of paper is supplied, label paper or tag paper.

That is, when the label paper in which labels are pasted with a predetermined space on a long mount rolled into a roll is printed, the light emitting element 45 which is built in the lower case 41 and the second light receiving element 55 which is built in the upper case 51 are arranged facing each other. Then, the light from the light emitting element 45 shines on the label paper which is passing between the above elements 45 and 55, and the amount of light which has transmitted through the label paper is detected with the second light receiving element 55.

As, in such a case, there is a difference between the amount of light which has transmitted through only the mount and that which has transmitted through the mount and the label, the front end or the rear end of the label is recognized by detecting the difference in the amounts of the both transmitted light.

On the other hand, in the case of the tag paper, there are marks, which indicate the distance between tags, on the tag paper, and there is a difference in the light reflectance ratio between the ratio for a part on which there is the mark and that for a part on which there is no mark. When such kind of the tag paper is printed, the above marks are detected using the light emitting element 45 and the first light receiving element 46 which are built in the lower case 41. That is, light from the light emitting element 45 shines on the tag paper, and reflected light from the tag paper is detected with the first light receiving element 46.

As, in such a case, there is a difference between the amount of light which has been reflected on a surface with no mark and that which has been reflected on a surface with the mark, the front end or the rear end of the label is recognized by detecting the difference in the amounts of the both reflected light.

Subsequently, the head unit 60 shown in FIG. 3 comprises a head supporting frame 610 and a thermal head 620 (line thermal head) as shown in the exploded and perspective view in FIG. 14. The head supporting frame 610 is formed like a box with an opening at the bottom part. On the other hand, in the thermal head 620, a line-like heater element 622 is installed on the lower surface of a head supporting plate 621. As shown in FIG. 15, with regard to the thermal head 620, the head supporting plate 621 is built inside of the head supporting frame 610 while the heater element 622 is exposed from the opening at the bottom part of the head supporting frame 610.

Figure 14:
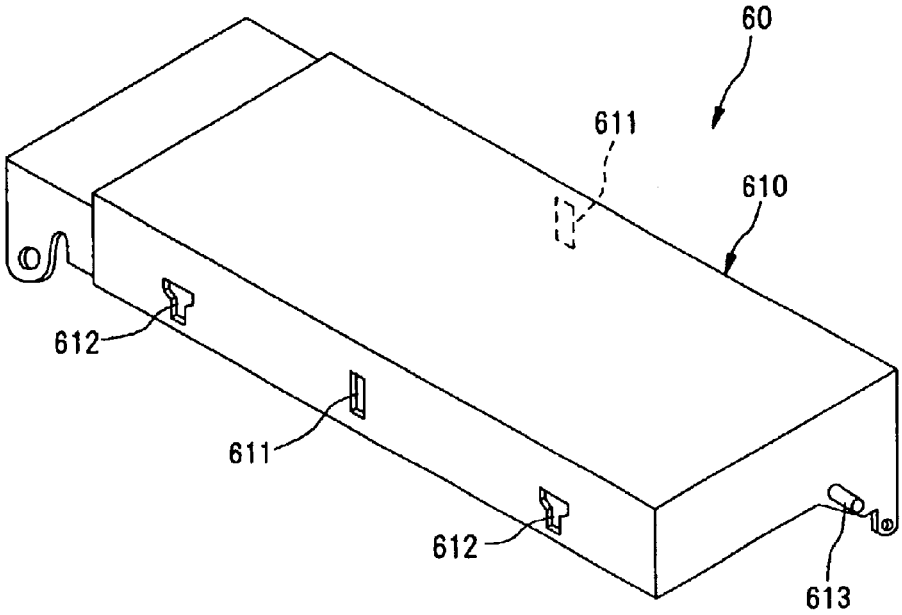
FIG. 14 is a exploded perspective view of a head unit.
Figure 14:
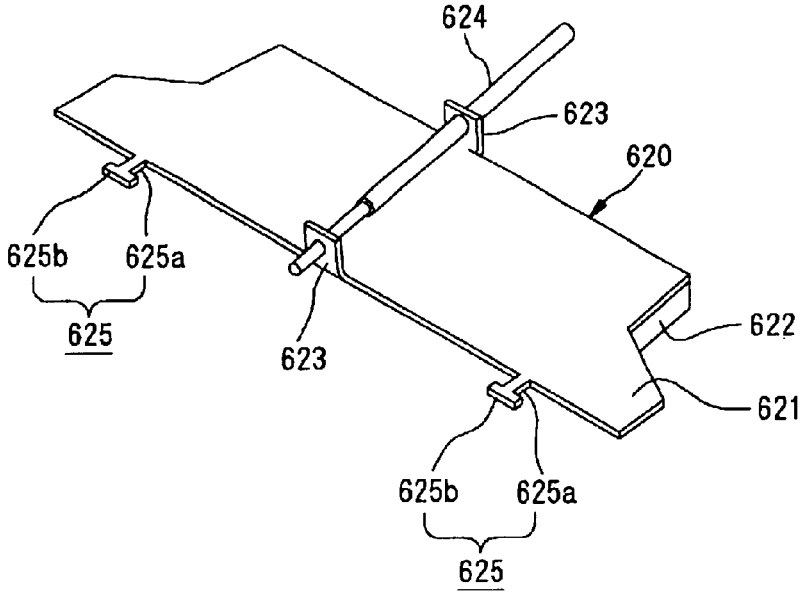
Figure 15:
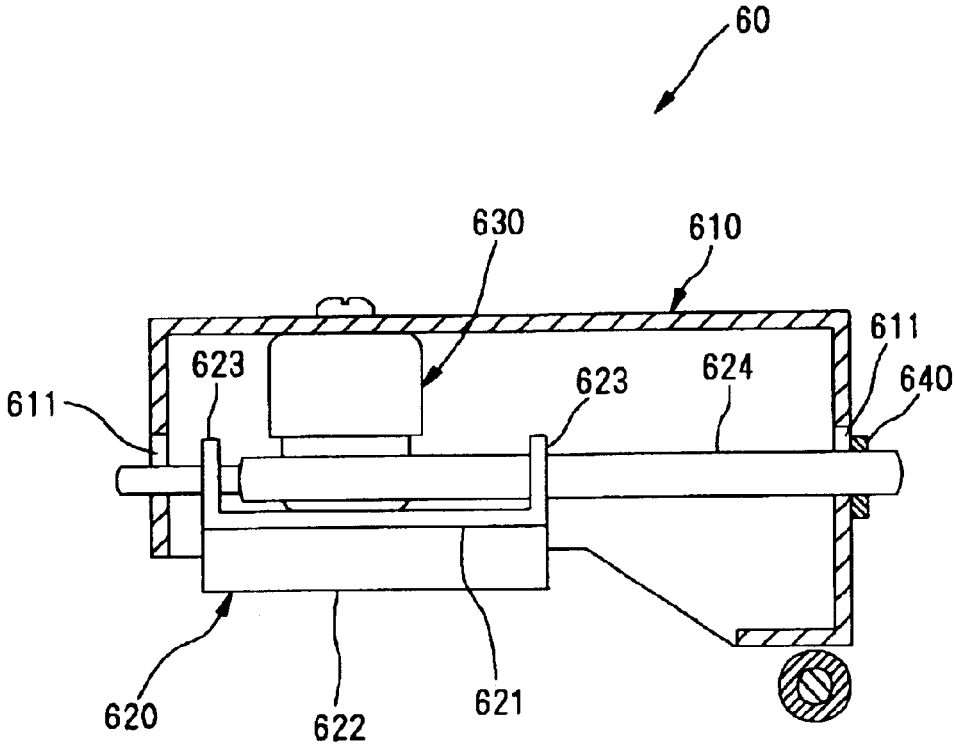
FIG. 15 is a sectional side view showing a head unit.

That is, as shown in FIG. 14, bearing sections 623 are formed in the center parts at the front end and the rear end of the head supporting plate 621, respectively, and a rod-like lever engaging pin 624 is supported and fixed, penetrating through the above bearing sections 623. Furthermore, hooks 625 which are protruding forward are formed near the both sides at the front end of the head supporting plate 621. The hooks 625 comprise arm sections 625*a* with a narrower width from the root part to the intermediate part and locking sections 625*b* with a wider width at the tip part.

On the other hand, long holes 611 are formed at the center parts on the front surface and the back surface of the head supporting frame 610, and notched sections 612 with steps are also formed neat the both sides at the front surface. The both end parts of the lever engaging pin 624 are penetrated through the above long holes 611, respectively. Moreover, the notched sections 612 have a larger width than that of the locking sections 625*b* of the hooks 625, which are formed on the head supporting plate 621, at the upper part above the stepped part, and, at the lower part under the stepped part, a width which is narrower than that of the locking sections 625*b* of the hooks 625 and is enough for insertion of the arm sections 625*a*. The hooks 625 of the head supporting plate 621 are inserted and locked into the notched sections 612.

Thus, as the thermal head 620 can be built into the head supporting frame 610 without requiring fasteners such as screws by engaging between the lever engaging pin 624 and the long holes 611 and by engaging between the hooks 625 and the notched sections 612, the built-in operation may be easily executed, and the maintenance may be also simple. And, the built-in thermal head 620 can be freely moved to the head supporting frame 610 by gaps of the long holes 611 and the notched sections 612.

Moreover, as shown in FIG. 15, a thermal head pressing unit 630 is installed on the inner ceiling surface of the head supporting frame 610 without interference with the lever engaging pin 624, and the thermal head 620 is flexibly energized to be pressed by the above unit 630 in the direction of the platen 31 (that is, downward).

Figure 16A:
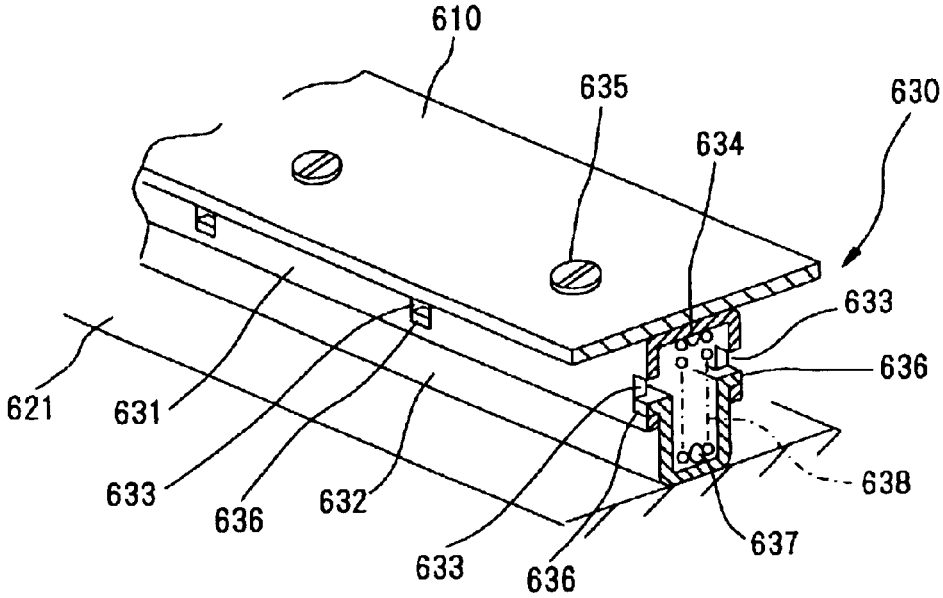
FIG. 16A is a perspective view showing a thermal head pressing unit.
Figure 16B:
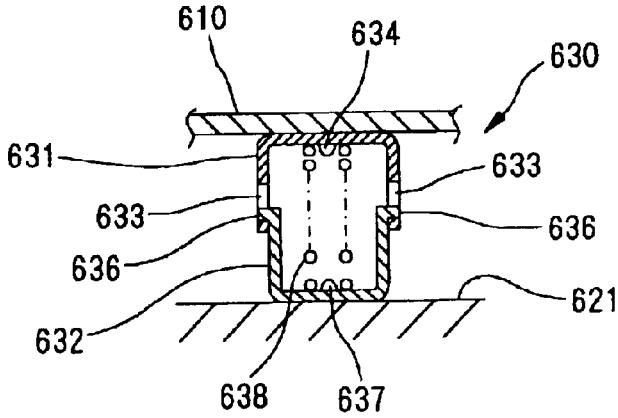
FIG. 16B is a sectional side view showing the thermal head pressing unit.

The thermal head pressing unit 630 comprises a displacement restricting member which has an upper case 631 and a lower case 632 as shown in FIGS. 16A and 16B. The upper case 631 has an opening space at the bottom, and a plurality of long holes 633 are formed with a predetermined distance on the side surface. A plurality of projections 634 are provided with a predetermined distance on the inner ceiling surface of the upper case 631. The upper surface of the upper case 631 is fixed to the inner ceiling surface of the head supporting frame 610 with a fastener 635 such as screws.

The lower case 632 has an opening space at the upper part, and a plurality of engaging projections 636 are formed with a predetermined distance on the top edge part, protruding to the sides. Furthermore, a plurality of projections 637 are also provided with a predetermined distance on the inner bottom surface of the lower case 632. The lower case 632 slidably engages with the upper case 631 so that the engaging projections 636 engage with the long holes 633 of the upper case 631, respectively. In the above engaged state, the projections 634 and 637 which are formed in the cases 631 and 632, respectively, are arranged facing each other, and helical compression springs 638 are disposed inside of the cased 631 and 632, respectively, in a state in which the both ends of the compression springs 638 are supported by the projections 634 and 637.

Here, the sliding surface between the lower case 632 and the upper case 631 functions as a sliding guide section which restricts the relative displacements in the direction (the transverse direction) perpendicularly intersecting with the energizing direction of the helical compression springs 638. And, the engaging projections 636 and the long holes 633 function as a stopper engaging section in which the engaging projections 636 rest on the inner bottom surfaces of the long holes 633 and further downward relative displacements are restricted (that is, elongations of the helical compression springs 638 are restricted).

With regard to the thermal head pressing unit 630 with the above configuration, there is no possibility that the helical compression springs 638 might be scattered when the thermal head 620 is removed from the head supporting frame 610, and there is no possibility hat buckling of the helical compression springs 638 might occurred even when the thermal head 620 is built in the head supporting frame 610. Accordingly, the built-in or disassembling operations may be further easily performed.

Figure 17:
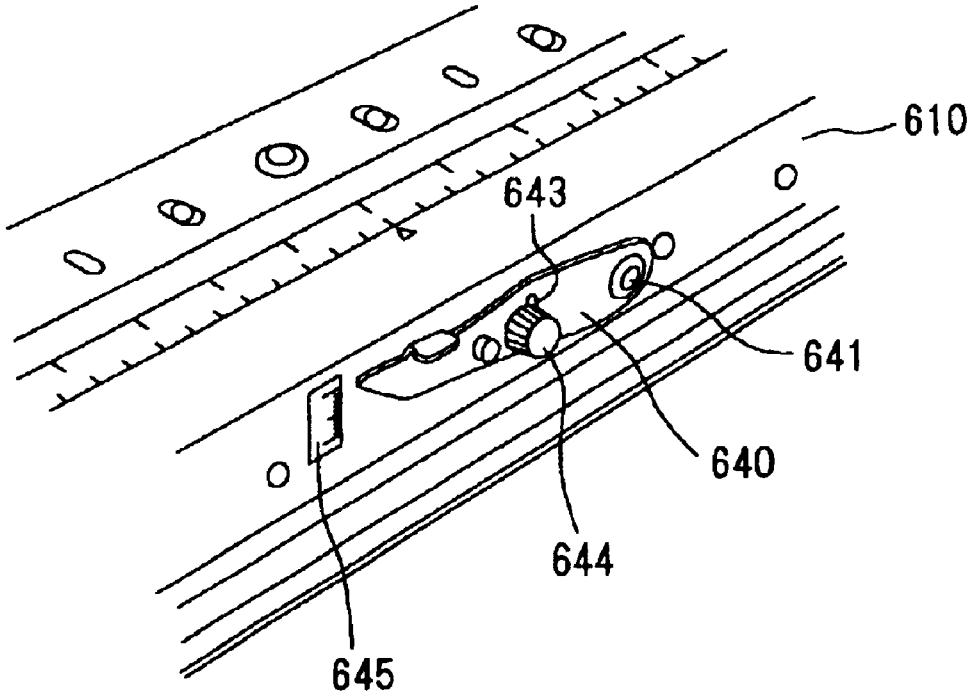
FIG. 17 is a perspective view showing the back of the head unit.

As shown in FIG. 17, an operation lever 640 which is arranged sideways is pivotable around the spindle 641 is installed on the back surface of the head supporting frame 610.

The rear end part of the above-described lever engaging pin 624 engages with the operation lever 640. In the intermediate part of the operation lever 640, a long hole 643 extending in the pivoting direction is formed, though not clearly shown in the figure, and a fastener 644 such as a screw is installed in the back surface of the head supporting frame 610 through the long hole 643. The operation lever 640 becomes pivotable within a range of the length of the long hole 643 by loosening the fastener 644. On the other hand, the operation lever 640 is pressed to the head supporting frame 610, and the pivoting movement is restricted by tightening the fastener 644.

In addition, a graduation 645 is provided near the tip part of the operation lever 640, and the tip of the operation lever 640 functions as an indicator for the graduation 645.

When the fastener 644 is loosened and the operation lever 640 is pivoted using the graduation 645 as a standard, the lever engaging pin 624 is also pivoted as one body and the thermal head 620 swings using the hooks 625 as fixed supporting points shown in FIG. 14. By the above swinging, the relative position between the heater element 622 of the thermal head 620 and the platen 31 may be adjusted.

It is preferable to execute the adjustment of the relative position according to the thickness of supplied paper. Generally, when label paper, tag paper and the like are printed, the operation lever 640 is pivoted downward and the back side of the thermal head 620 is lowered. Conversely, when thin paper is printed, it is required to lift the back side of the thermal head 620 after pivoting the operation lever 640 upward. Thereby, the facing position of the thermal head 620 to the platen 31 is slightly adjusted. Moreover, even when manufacturing errors and the like cause deviation of the center position of the heater element 622, which is provided in the thermal head 620, from a contact point with the platen 31, the position of the heater element 622 to platen 31 can be adjusted by pivoting operation of the operation lever 640.

As shown in FIG. 5, the above-described head unit 60 is installed in the main-body frame 14 through a hinge section 650 at the one end part and is pivotable around the hinge section 650 between a printing position close to the platen 31 and a stand-by position away from the platen 31. Thereby, when paper or a ribbon is loaded, the lower surface of the paper carrying path 1 or the thermal head 620 is opened by lifting the head unit 60 to the stand-by position to allow easier installation of the paper or the ribbon.

Figure 18A:
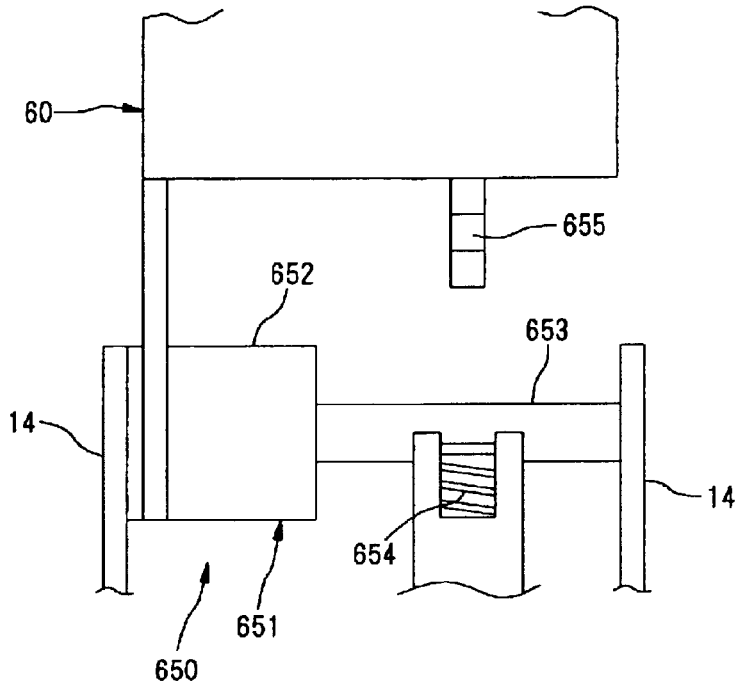
FIG. 18A is a front view showing a state in which the hinge section of the head unit is opened.
Figure 18B:
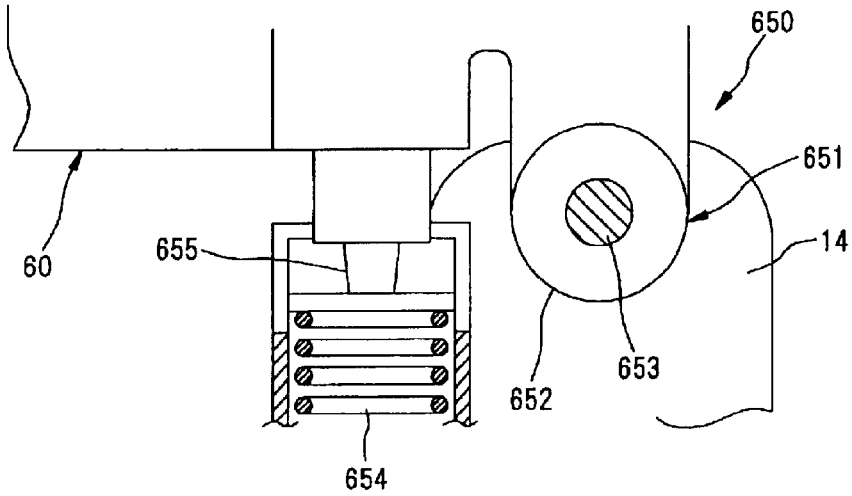
FIG. 18B is a side view showing a state in which the hinge section of the head unit is opened.

As shown in FIGS. 18A and 18B, the hinge section 650 is provided with a one-way torque control mechanism 651, through which one end part of the head unit 60 and the main-body frame 14 are pivotably linked. The one-way torque control mechanism 651 comprises a mechanism main-body 652 with self-contained components for torque control and a spindle 653 which is extending from the mechanism main-body 652, to which the one end part of the head unit 60 is fixed. Moreover, the spindle 653 extending from the mechanism main-body 652 is fixed to the main-body frame 14.

The spindle 653 is disposed parallel to the paper carrying direction in a printing section, and the head unit 60 is configured to be pivotable along a virtual plane which is perpendicularly intersecting with the spindle 653.

Here, the one-way torque control mechanism 651 is a hinge mechanism which has both a one-way clutch function and a torque-limiter one, and has a structure in which, when the head unit 60 is pivoted from the stand-by position to the printing one, load torque which is independent from the pivoting speed and is of predetermined load torque in the loading direction is applied to the spindle 653 inside of the mechanism main-body 652. The value of the load torque which is applied in the loading direction at this time is configured to be set in such a way that the own weight of the head unit 60 may be supported. Accordingly, when the head unit 60 is pivoted from the stand-by position to the printing one, it is possible to prevent a state in which the head unit 60 vigorously falls down based on the own weight and collides with the platen 31.

Furthermore, the one-way torque control mechanism 651 has a structure in which, when the head unit 60 is pivoted from the printing position to the stand-by one, load torque in the unloading direction which is of smaller load torque than the load in the loading direction is applied to the spindle 653 inside of the mechanism main-body 652. Preferably, the value of the load torque which is applied in the unloading direction at this time is set to be approximately zero. By the above setting, the load at a time in which the head unit 60 is pivoted from the printing position to the stand-by one (that is, it is lifted) becomes only the own weight of the head unit 60 to reduce the loading capacity required at the pivoting operation.

In addition, a head pop-up spring 654 which comprises a helical compression spring is provided near the hinge section 650 in the main-body frame 14. On the other hand, a spring seat section 655 which pressed the head pop up spring 654 at the printing position is formed on the head unit 60. The head pop up spring 654 is being compressed by the spring seat section 655 (Refer to FIG. 18B), when the head unit 60 is at the printing position.

Figure 19:
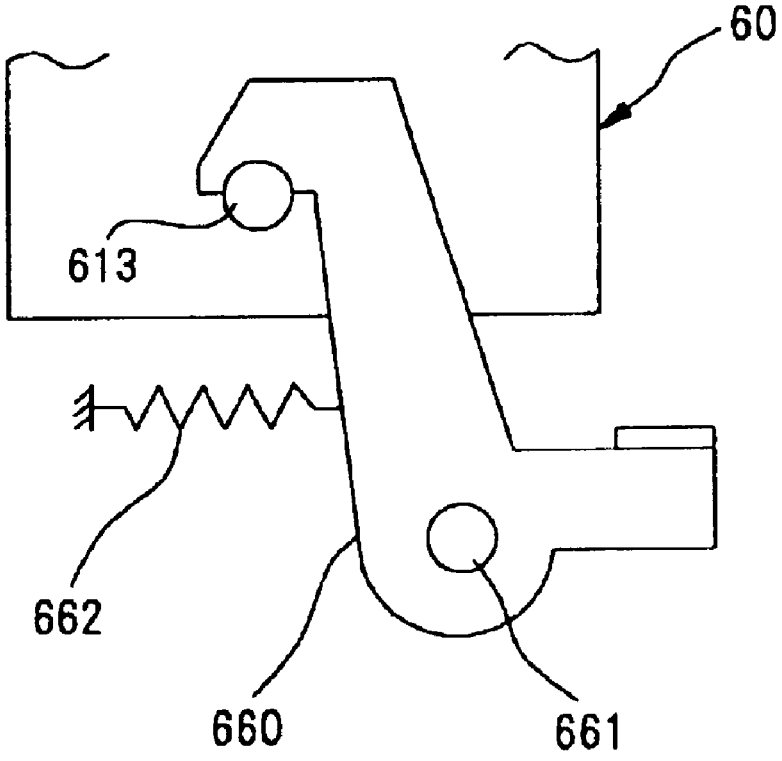
FIG. 19 is a side view showing a head locking member.

As shown in the side view in FIG. 19, a head locking member 660 which locks the other end section of the head unit 60 and fixes it at the printing position is provided at the other end in the width direction of the main-body frame 14 (the other side of the hinge section 650), and an engaging pin 613 which is locked by the head locking member 660 is provided in a protruding manner at the other end part of the head unit 60. That is, the head unit 60 which has pivoted to the printing position is prevented by locking the engaging pin 613 with the head locking member 660 from further pivoting to the stand-by position.

The head locking member 660 is configured to be pivotable around the spindle 661, and to be energized by a spring member 662 at any time in such a way that the engaging pin 613 is locked. When the head locking member 660 is pivoted against the energizing force of the spring member 662, the state in which the engaging pin 613 is locked with the above locking member 660 is released.

At this time, the head unit 60 is automatically lifted up by energizing force of the above-described head pop-up spring 654 to a position at which the engaging pin 613 is never locked with the head locking member 660. Therefore, the releasing operation of the state in which the engaging pin 613 is locked with the head locking member 660 may be performed at user's fingertips. Moreover, the operability is extremely good, as the above unit 60 is not required to be supported considering the returning of the head unit 60.

Returning to FIGS. 6 and 7, the ribbon installing unit 70 is provided on the upper surface of the head unit 60. The ribbon installing unit 70 comprises a ribbon housing 710 which is provided at one end part of the head unit 60 in the width direction, a supplying-side bearing section 730 and a winding-side bearing section 731, which are provided side by side in the other-end section in the width direction.

Figure 20:
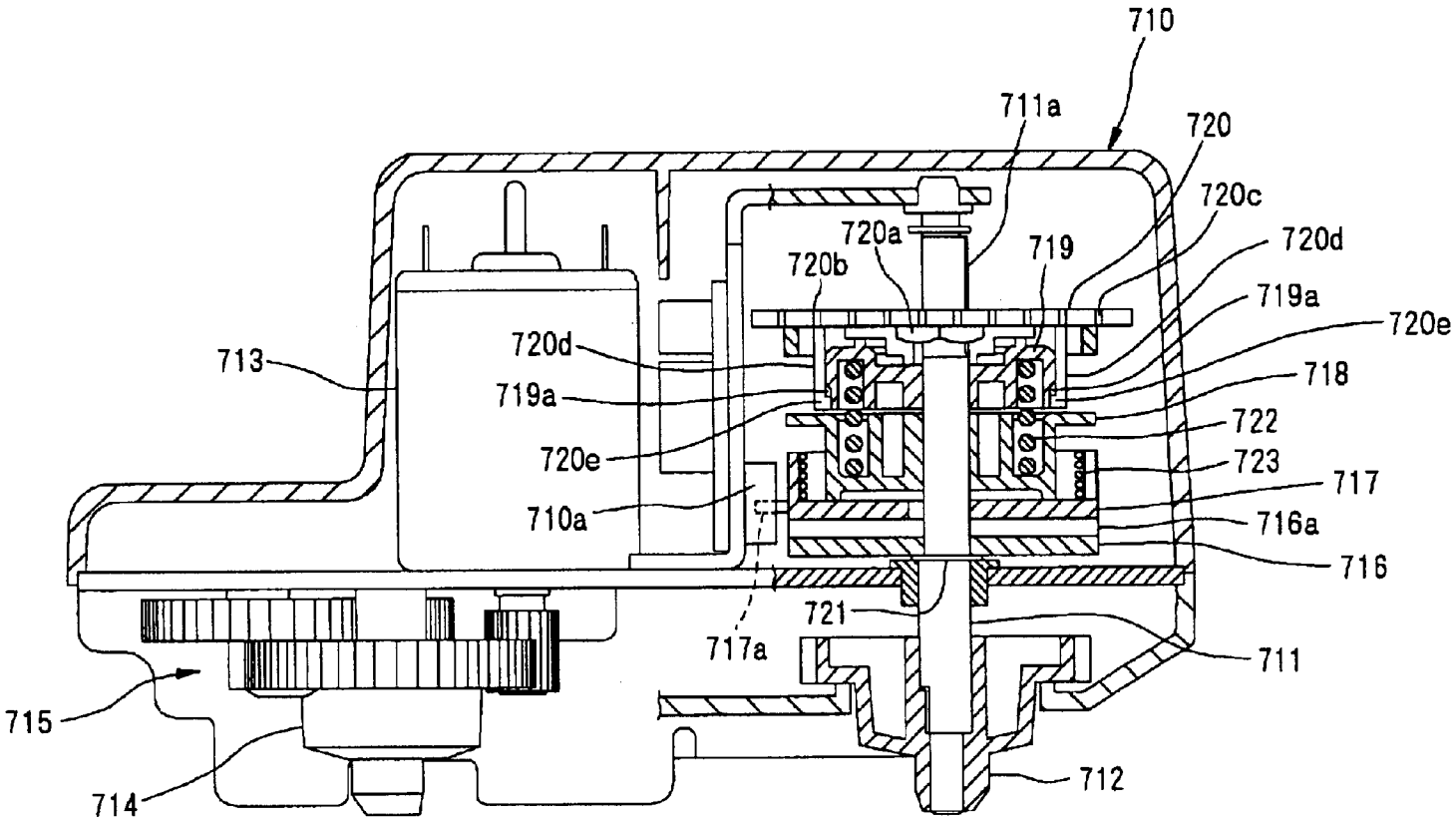
FIG. 20 is a sectional plan view showing an internal structure of a ribbon housing which forms a ribbon installing unit.

As shown in FIG. 20, a supply shaft 711 is rotatably supported at the back side in the ribbon housing 710, and a supply bobbin 712 is installed at the tip of the supply shaft 711. The tip section of the supply bobbin 712 is exposed from the ribbon housing 710 and is facing the supplying-side bearing section 730 on the same horizontal plane.

On the other hand, in the front side of the inside of the ribbon housing 710, a driving motor 713 for ribbon winding (ribbon winding motor) and a gear mechanism 715 which transmits rotation driving force of the ribbon winding motor 713 to a winding bobbin 714 are self-contained. The tip section of the winding bobbin 714 is also exposed from the ribbon housing 710 and is facing the winding-side bearing section 731 on the same horizontal plane.

As shown in FIG. 7, one end of the ribbon shaft 740 (ribbon supply shaft) is inserted and is fixed to the supply bobbin 712 in order to fit and fix the ribbon tube onto which the belt-like ink ribbon 3 is wound, and the other end is rotatably mounted on the supplying-side bearing section 730 for engagement and fixation of a ribbon tube onto which a belt-like ink ribbon 3 is wound. Moreover, a winding tube which the tip edge of the ink ribbon 3 drawn out from the ribbon tube is connected is fitted and fixed to a winding shaft 741 (ribbon winding shaft) One end of the winding shaft 741 is inserted and fixed to the winding bobbin 714, and the other end is rotatably mounted on the winding-side bearing section 731. Here, the ink ribbon 3 drawn out from the ribbon tube is arranged in such a way that the above ribbon 3 is passing through the lower surface of the head unit 60 (that is, the heater element 622 of thermal head 620). Then, when the winding shaft 741 is driven for rotation by rotating the ribbon winding motor 713, the ink ribbon 3 on the side of the ribbon shaft 740 is wound through the lower surface of the head unit 60.

Here, in order to carry the ink ribbon 3 in a state in which there is no slack or no wrinkle, it is preferable to control the rotating torque of the ribbon winding motor 713 within a predetermined range in such a way that predetermined tension is applied to the ink ribbon 3 from the starting to the termination of winding the ink ribbon 3 onto the winding tube. Accordingly, constant current control of the ribbon winding motor 713 is performed in the present embodiment to apply predetermined tension to the ink ribbon 3 with predetermined rotating torque even when the winding amount of the ink ribbon 3 is changed.

However, various types of ink ribbons 3 which are different from each other in the width and the winding diameter are prepared, and a user is required to select and install a ribbon with a suitable width and a winding diameter according to demand. Therefore, in the case of the constant current control of the ribbon winding motor 713 with a large current value under assumption that the ink ribbon 3 has a wider width and a large winding diameter, the rotating torque becomes large. Accordingly, under the above constant current control, the tension applied to the ink ribbon 3 becomes excessive to have a possibility that wrinkles are caused, and, consequently, the ink ribbon 3 is broken, when an ink ribbon 3 with a narrower width and a small winding diameter is installed.

Based on the above circumstances, the present embodiment has a configuration in which a plurality of patterns for current flowing in brushes of the ribbon winding motor 713 are set and stored in self-contained memories in the control box 15 in advance which is shown in FIG. 3. For example, current values such as $I_1$, $I_2$, $I_3$, $I_4$, $I_5$ ($I_1<I_2<I_3<I_4<I_5$), which are different from each other are set in the memories, and it is preferable to select a larger current value (for example, $I_5$) and to obtain larger rotating torque, when a ink ribbon 3 with a larger winding diameter and a wider width is installed. Conversely, it is preferable to select a smaller current value (for example, $I_1$) and to obtain smaller rotating torque, when a ink ribbon 3 with a small winding diameter and a narrower width is installed.

Moreover, it is preferable that the above patterns are set or selected in cooperation with the rotating resistance of the winding shaft 741 which is adjusted with a braking mechanism.

Figure 21:
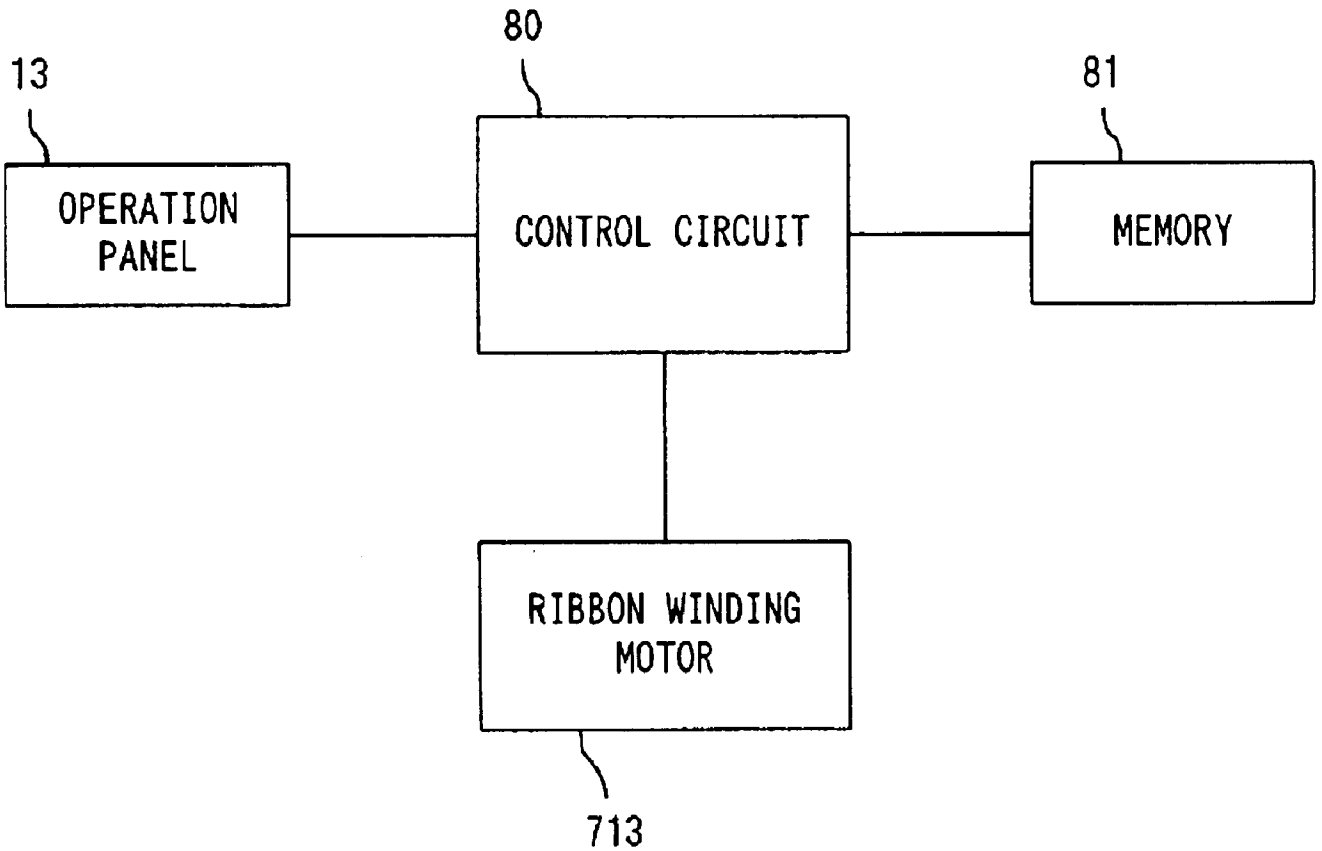
FIG. 21 is a block diagram showing a control system for a ribbon winding motor.

FIG. 21 is a block diagram showing a control system of the ribbon winding motor.

The above selection of the current value may be realized using the operation panel 13 (selection unit). That is, the current value selected with the operation panel 13 is read from a memory 81 (storage unit), and the datum is sent to a control circuit 80 (control unit). The control circuit 80 performs the constant current control of the ribbon winding motor 713 based on the above selected datum for driving and rotation of the above motor 713.

Again, returning to FIG. 20, a braking mechanism with the following structure is provided at the supply shaft 711 which is rotatably supported in the ribbon housing 710.

That is, a disk-like first friction member 716, a ring-like second friction member 717, a pressing member 718 and a spring seat member 719 (pressure receiving member) are individually fitted to the supply shaft 711. In addition, a ring-like operation member 720 is screwed to the above shaft 711.

Among the above members, the first friction member 716, the pressing member 718 and the spring seat member 719 have limitation in relative rotation to the supply shaft 711 and rotate as one body together with the supply shaft 711. Furthermore, the first friction member 716, the pressing member 718 and the spring seat member 719 are movable in the axial direction to the supply shaft 711. However, as the first friction member 716 rests on a washer 721 which is mounted on the supply shaft 711, one of movements of the above member 716 (downward movement in FIG. 20) is restricted. Here, in order to allow the above rotation and the above movement in the axial direction which have been restricted, the supply shaft 711 is configured to have a D-shape cross section, and the first friction member 716, the pressing member 718 and the spring seat member 719 are configured to have a D-shape shaft hole with which the D-shape supply shaft 711 engages.

The operation member 720 is formed by outside molding of a metal nut 720*a* with plastic material, and screwed into a screwed section 711*a* which has been formed by the nut 720*a* on the supply shaft 711. Furthermore, a disk-like operation section 720*b* is formed in the operation member 720, and a knurled grooves 720*c* are formed on the outer peripheral surface of the operation section 720*b* with a predetermined distance. The width of the grooves 720*c* is configured to have a size as described later so that a coin may be inserted into them.

Moreover, one, or a plurality of (two in FIG. 20) arms 720*d* (engaging arm sections), which are extending to the outer periphery of the spring seat member 719, are formed in the operation member 720 and bent engaging sections 720*e* are formed at the tips of the arms 720*d*. On the other hand, engaging concave sections 719*a* (engaging sections) are formed on the outer peripheral surface of the spring seat member 719 with a predetermined distance, and, as described later, the engaging sections 720*e* of the arms 720*d* are configured to engage and disengage with the engaging concave sections 719*a* to obtain a feeling of clicking when the spring seat member 719 and the operation member 720 make relative rotation to each other.

The second friction member 717 is relatively rotatable to the supply shaft 711 and movable in the axial direction. However, an engaging section 717*a* which is protruding is formed in a part of the second friction member 717 and free rotation is restricted by engaging with the engaging section 717*a* by a stopper section 710*a* which is provided in the ribbon housing 710.

A friction contacting section 716*a* which is made of material such as felt is provided on one side surface of the first friction member 716, and a part of the side surface of the second friction member 717 rests on the above friction contacting section 716*a*.

Then, a first elastic member 722 (energizing member) which comprises a helical compression spring and the like is configured to be provided between the spring seat member 719 and the pressing member 718. The movement of the spring seat member 719 in the axial direction is restricted as the pressing force which is received from the first elastic member 722 is received by the operation member 720. The pressing member 718 transmits the pressing force received from the first elastic member 722 to the second friction member 717. The pressing force makes the second friction member 717 rest on the friction contacting 716*a* which is provided on the first friction member 716.

When the supply shaft 711 is rotated in the direction in which the ink ribbon 3 is supplied, the first friction member 716 is rotated together with the supply shaft 711, and rotation of the second friction member 717 is prevented, as the engaging section 717*a* engages with the stopper section 710*a* which is provided in the ribbon housing 710.

Accordingly, frictional force is generated between the friction members 716 and 717, and the frictional force functions as braking torque to the supply shaft 711. Thereby, braking action is generated on the supply shaft 711 to prevent oversupply of the ribbon 3 by inertia to keep a state in which the ribbon 3 has no slack.

Here, when the supply shaft 711 is rotated in the direction in which the ink ribbon 3 is not supplied, the engaging section 717*a* which is formed to the second friction member 717 separates from the stopper section 710*a* which is provided in the ribbon housing 710 to rotate the supply shaft 711. Then, the second friction member 717 is energized by the second elastic member 723 which is made of helical torsion springs in the direction in which the ink ribbon 3 is prevented from not supplying.

Subsequently, a method which adjusts the braking torque for rotation of the ink ribbon 3 will be explained.

Figure 22A:
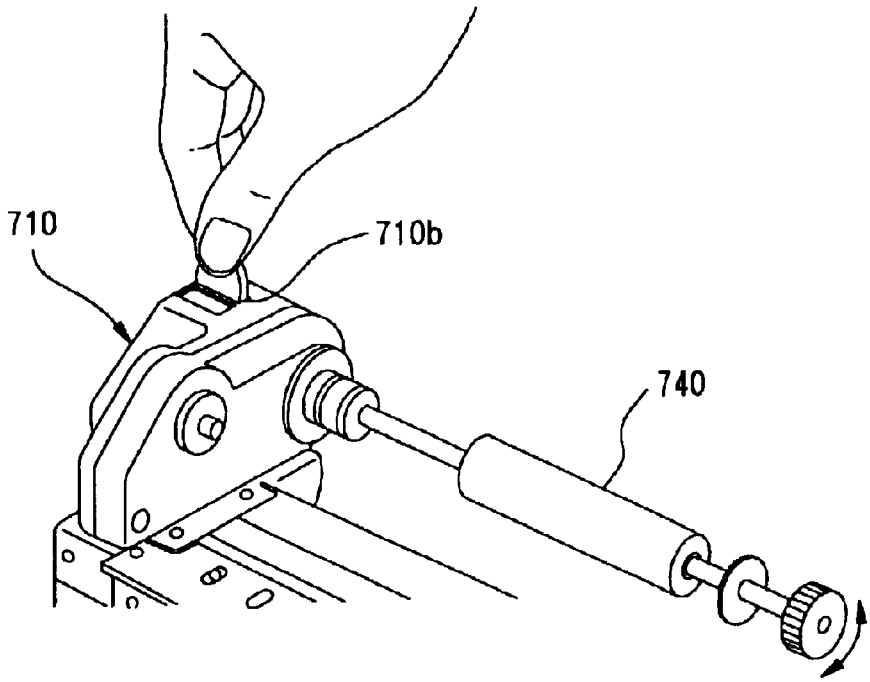
FIG. 22A is a perspective view explaining operation procedures for a braking mechanism for the ink ribbon which is self-contained in the ribbon housing.

As shown in FIG. 22A, in the ribbon housing 710, there is provided a notched hole 710*b* at a position in which the above hole faces the grooves 720*c* formed in the operation section 720*b* of the operation member 720. Then, a coin is inserted into the grooves through the above notched hole 710*b* to restrict the rotation of the operation member 720. In the above situations, when the ribbon shaft 740 which is inserted into the supply bobbin 712 for fixing is rotated in the supplying direction, the supply shat 711 shown in FIG. 20 is rotated to cause axial-direction relative-movement of the nut 720*a* in the operation member 720 to the screwed section 711*a* of the supply shaft 711. Along with the above relative movement, the spring seat member 719 is also moved in a relative manner together with the operation member 720. Accordingly, the distance between the spring seat member 719 and the pressing member 718 is made enlarged or shrunk to extend or compress the first elastic member 722. Thereby, the pressing force which is transmitted from the first elastic member 722 to the second friction member 717 through the pressing member 718 is change to cause change in the braking torque.

Preferably, the braking torque is adjusted according to the mass of the ink ribbon 3. For example, as the inertia force at rotation becomes larger according to increased mass when an ink ribbon 3 with a large winding diameter and a wide width is installed, the braking torque is required to be adjusted a little bit larger. On the other hand, the braking torque is conversely required to be adjusted a little bit smaller, when an ink ribbon 3 with a small winding diameter and a narrow width is installed.

When the braking torque is adjusted according to the above-described procedures, the engaging sections 720*e* of the arms 720*d* engage and disengage, along with the relative rotation between the spring seat member 719 and the operation member 720, with the engaging concave sections 719*a*, respectively, to obtain the feeling of clicking. Therefore, sensory grasping of the adjusting amount may be realized by the frequency of the engagement and the disengagement.

Figure 22B:
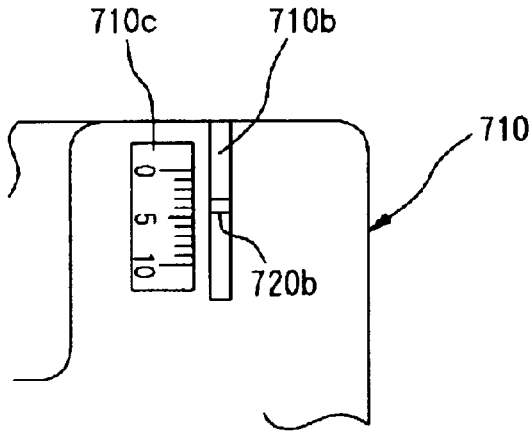
FIG. 22B is an enlarged plan view of a graduation which is provided in the ribbon housing.

Furthermore, as a graduation 710*c* is provided to the side of the notched hole 710*b* in the ribbon housing 710 as shown in FIG. 22B, the adjusting amount of the braking torque is configured to be objectively judged by adjusting the position of the operation section 720*b* which is visible through the notched hole 710*b*, using the graduation 710 as a standard.

Here, the present invention is not limited to the above-described embodiment.

For example, the applicable printer is not limited to the line thermal printer, and various kinds of printers which use the ink ribbon are applicable.

Though a plurality of patterns for the current of the ribbon winding motor 713 have been stored in the memory 81 (storage unit) in advance in the above-described embodiment, a plurality of winding torque patterns for the winding torque of the winding shaft 741 may be stored in the memory 81 in advance.

It is preferable to set the above patterns so that the tension applied to the ink ribbon, which is between the printing head (thermal head 620) and the winding shaft 741, is an approximate predetermined value according to the kind of the ink ribbon installed on the ribbon supply shaft 711 from the start to the end of the winding.

It is preferable that the above patterns are set or selected in cooperation with the rotating resistance of the winding shaft 741 which is adjusted with the braking mechanism.

Then, for example, a plurality of winding torque values which are different from each other are stored in the memory 81 in advance, and a large winding torque value is selected using the operation panel 13 (selection unit) when an ink ribbon 3 with a large winding diameter and a wide width is installed on the supply shaft 711 shown in FIG. 20.

The winding torque value selected with the operation panel 13 is read from the memory 81 (storage unit), and the datum is sent to the control circuit 80 (control unit). The control circuit 80 performs constant current control of the ribbon winding motor 713 with the current, based on the above selected datum so that the winding shaft 741 is rotated with the selected winding torque.

In addition, a plurality of rotating torque patterns for the rotating torque of the winding shaft 741, instead of the current of the ribbon winding motor 713 and the winding torque of the winding torque of the winding shaft 741, may be stored in the memory 81 in advance.

It is preferable to set the above patterns so that the tension applied to the ink ribbon, which is between the printing head (thermal head 620) and the winding shaft 741, is an approximate predetermined value according to the kind of the ink ribbon installed on the ribbon supply shaft 711 from the start to the end of the winding.

Furthermore, it is preferable that the above patterns are set or selected in cooperation with the rotating resistance of the winding shaft 741 which is adjusted with the braking mechanism.

A plurality of rotating torque values which are different from each other are stored in the memory 81 in advance, and a large rotating torque value is selected using the operation panel 13 (selection unit) when an ink ribbon 3 with a large winding diameter and a wide width is installed on the supply shaft 711 shown in FIG. 20.

The rotating torque value selected with the operation panel 13 is read from the memory 81 (storage unit), and the datum is sent to the control circuit 80 (control unit). The control circuit 80 performs constant current control of the ribbon winding motor 713 with the current, based on the above selected datum so that the winding shaft 741 is rotated with the selected winding torque.

What is claimed is:

1. A printer in which an ink ribbon and paper on said ink ribbon are carried between a print head and a platen, in a state such that said ink ribbon is pressed against said paper, for printing on said paper, comprising:

a ribbon supply shaft which supports said ink ribbon supplied between said printing head and said platen;

a ribbon winding shaft which winds said ink ribbon sent from said ribbon supply shaft;

a driving motor which drives and rotates said ribbon winding shaft;

a storage unit which stores a plurality of current patterns for the driving current of said driving motor, said patterns having been set in advance;

a selection unit which selects any one of said plurality of current patterns;

a control unit which drives said driving motor based on the current pattern selected with said selection unit; and a braking mechanism which adjusts the rotating resistance applied to said ribbon winding shaft; wherein the plurality of current patterns are set and stored in said storage unit in advance so that the tension applied to said ink ribbon, which is between said printing head and said winding shaft, is an approximate predetermined value in cooperation with said rotating resistance of said ribbon winding shaft, while said resistance is adjusted with said braking mechanism from the start to the end of ribbon winding.

2. The printer according to claim 1, wherein said storage unit is a memory which stores said plurality of current patterns.

3. The printer according to claim 2, wherein said selection unit is an operation panel which is provided in a case of a main-body of said printer.

4. The printer according to claim 3, wherein said control unit is a control circuit which drives said driving motor based on the current pattern selected on said operation panel and read from said memory.

5. A printer in which an ink ribbon and paper on said ink ribbon are carried between a print head and a platen, in a state such that said rink ribbon is pressed against said paper, for printing on said paper, comprising:

a ribbon supply shaft which supports said ink ribbon supplied between said printing head and said platen;

a ribbon winding shaft which winds said ink ribbon sent from said ribbon supply shaft;

a driving motor which drives and rotates said ribbon winding shaft;

a storage unit which stores a plurality of winding torque patterns for the winding torque of said winding shaft, said patterns having been set in advance;

a selection unit which selects any one of said plurality of winding torque patterns;

a control unit which controls said winding torque of said winding shaft based on the winding torque pattern selected with said selection unit; and a braking mechanism which adjusts the rotating resistance applied to said ribbon winding shaft; wherein the plurality of winding torque patterns are set and stored in said storage unit in advance so that the tension applied to said ink ribbon, which is between said printing head and said winding shaft, is an approximate predetermined value in cooperation with said rotating resistance of said ribbon winding shaft, while said resistance is adjusted with said braking mechanism from the start to the end of ribbon winding.

6. The printer according to claim 5, wherein said storage unit is a memory which stores said plurality of winding torque patterns.

7. The printer according to claim 6, wherein said selection unit is an operation panel which is provided in a case of a main body of said printer.

8. The printer according to claim 7, wherein said control unit is a control circuit which controls said winding torque of said winding shaft based on the winding torque pattern selected on said operation panel and read from said memory.

9. A printer in which an ink ribbon and paper on said ink ribbon are carried between a print head and a platen, in a state such that said ink ribbon is pressed against said paper, for printing on said paper, comprising:

a ribbon supply shaft which supports said ink ribbon supplied between said printing head and said platen;

a ribbon winding shaft which winds said ink ribbon sent from said ribbon supply shaft;

a driving motor which drives and rotates said ribbon winding shaft;

a storage unit which stores a plurality of rotating torque patterns for the rotating torque of said winding shaft, said patterns having been set in advance;

a selection unit which selects any one of said plurality of rotating torque patterns;

a control unit which controls said winding torque of said winding shaft based on the rotating torque pattern selected with said selection unit; and a braking mechanism which adjusts the rotating resistance applied to said ribbon winding shaft; wherein a plurality of rotating torque patterns are set and stored in said storage unit in advance so that the tension applied to said ink ribbon, which is between said printing head and said winding shaft, is an approximate predetermined value in cooperation with said rotating resistance of said ribbon winding shaft, while said resistance is adjusted with said braking mechanism from the start to the end of ribbon winding.

10. The printer according to claim 9, wherein said storage unit is a memory which stores said plurality of rotating torque patterns.

11. The printer according to claim 10, wherein said selection unit is an operation panel which is provided in a case of a main body of said printer.

12. The printer according to claim 11, wherein said control unit is a control circuit which controls said winding torque of said winding shaft based on the rotating torque pattern selected on said operation panel and read from said memory.

* * * * *